US011864668B2

(12) United States Patent
Arnold, IV et al.

(10) Patent No.: US 11,864,668 B2
(45) Date of Patent: Jan. 9, 2024

(54) CHILD CONTAINMENT SYSTEM WITH MULTIPLE INFANT SUPPORT MODES

(71) Applicant: GRACO CHILDREN'S PRODUCTS INC., Atlanta, GA (US)

(72) Inventors: John (Jason) C. Arnold, IV, Philadelphia, PA (US); Brandon Burkholder, Atlanta, GA (US); Annette Stella, Dowington, PA (US); Matthew Rivera, Mableton, GA (US)

(73) Assignee: GRACO CHILDREN'S PRODUCTS INC., Atlanta, GA (US)

( * ) Notice: Subject to any disclaimer, the term of this patent is extended or adjusted under 35 U.S.C. 154(b) by 0 days.

(21) Appl. No.: 17/321,218

(22) Filed: May 14, 2021

(65) Prior Publication Data

US 2021/0274945 A1 Sep. 9, 2021

Related U.S. Application Data

(63) Continuation of application No. 15/816,628, filed on Nov. 17, 2017, now Pat. No. 11,013,345, which is a (Continued)

(51) Int. Cl.

| | |
|---|---|
| ***A47D 9/00*** | (2006.01) |
| ***A47D 9/02*** | (2006.01) |
| ***A47D 11/00*** | (2006.01) |

(52) U.S. Cl.

CPC ..... *A47D 9/016* (2022.08); *A47D 9/053* (2022.08); *A47D 11/007* (2013.01)

(58) Field of Classification Search

CPC ..... A47D 11/00; A47D 11/007; A47D 7/00; A47D 7/04; A47D 9/00; A47D 9/005; A47D 9/02

See application file for complete search history.

(56) References Cited

U.S. PATENT DOCUMENTS

| | | | |
|---|---|---|---|
| 234,016 | A | 11/1880 | Fosburgh |
| 813,521 | A | 2/1906 | Reilly |

(Continued)

FOREIGN PATENT DOCUMENTS

| | | | |
|---|---|---|---|
| CN | 101297726 | A | 11/2008 |
| DE | 20000537 | U1 | 8/2000 |

(Continued)

OTHER PUBLICATIONS

Chinese Office Action issued in CN Application No. 201010138700.9, dated Aug. 31, 2011.

(Continued)

*Primary Examiner* — Fredrick C Conley

(74) *Attorney, Agent, or Firm* — Eversheds Sutherland (US) LLP

(57) ABSTRACT

A child containment system has a child containment structure with a bottom and a perimeter wall surrounding the bottom. A bassinet has an infant support surface and a surrounding wall around the infant support surface. The bassinet can be mounted to the child containment structure with the infant support surface elevated above the bottom of the child containment structure. An infant support unit can have a frame, a bed supported by the frame, and legs that extend from one end infant support unit to the distal second end. The infant support unit is configured for use in a first operational mode in which the infant support unit at least partially positioned within the child containment structure with the bed overlying the bassinet's infant support surface, and with a portion of the legs contacting the bassinet's infant support surface.

14 Claims, 18 Drawing Sheets

Related U.S. Application Data continuation of application No. 15/613,593, filed on Jun. 5, 2017, now Pat. No. 9,861,209, which is a continuation of application No. 15/237,094, filed on Aug. 15, 2016, now Pat. No. 9,706,855, which is a continuation of application No. 14/313,643, filed on Jun. 24, 2014, now Pat. No. 9,414,694, which is a continuation of application No. 13/682,241, filed on Nov. 20, 2012, now Pat. No. 8,893,325, which is a continuation of application No. 12/724,283, filed on Mar. 15, 2010, now Pat. No. 8,316,481.

(56) References Cited

U.S. PATENT DOCUMENTS

| | | | | |
|---|---|---|---|---|
| 1,827,687 | A | 10/1931 | McCandless | |
| 2,128,978 | A | 9/1938 | Akin | |
| 2,260,584 | A | 10/1941 | Schuck et al. | |
| 2,280,913 | A | 4/1942 | Hummel et al. | |
| 2,553,087 | A | 5/1951 | Hanson | |
| 2,636,548 | A * | 4/1953 | Berlin | A47D 1/103 5/94 |
| 2,752,614 | A | 7/1956 | Hayward | |
| 2,828,489 | A | 4/1958 | Baker | |
| 2,851,700 | A | 9/1958 | Denison | |
| 3,146,736 | A | 9/1964 | Hetrick | |
| 3,156,197 | A | 11/1964 | Walz | |
| 3,427,666 | A | 2/1969 | Saxe | |
| 3,644,947 | A | 2/1972 | Padera | |
| 3,839,754 | A | 10/1974 | Hooper | |
| 3,864,048 | A | 2/1975 | Parker | |
| 3,890,660 | A | 6/1975 | Pedler | |
| 3,912,407 | A | 10/1975 | Heininger | |
| 4,021,127 | A | 5/1977 | Gasparro et al. | |
| 4,073,017 | A | 2/1978 | Stevens | |
| 4,473,316 | A | 9/1984 | Welch | |
| 4,561,138 | A | 12/1985 | Hwang | |
| 4,965,896 | A | 10/1990 | Berger et al. | |
| 4,967,432 | A | 11/1990 | Kujawski et al. | |
| 5,025,517 | A | 6/1991 | Johnson | |
| 5,163,191 | A | 11/1992 | Chan | |
| 5,274,863 | A | 1/1994 | Fountain | |
| 5,339,470 | A | 8/1994 | Shamie | |
| 5,349,709 | A | 9/1994 | Cheng | |
| 5,381,570 | A | 1/1995 | Cheng | |
| 5,446,934 | A | 9/1995 | Frazier | |
| 5,542,151 | A | 8/1996 | Stranski et al. | |
| 5,553,336 | A | 9/1996 | Mariol | |
| 5,615,427 | A | 4/1997 | Huang | |
| 5,778,465 | A | 7/1998 | Myers | |
| 5,845,349 | A | 12/1998 | Tharalson et al. | |
| 5,855,031 | A | 1/1999 | Swift, Jr. | |
| 5,867,850 | A | 2/1999 | Mariol | |
| 5,918,329 | A | 7/1999 | Huang | |
| 5,947,552 | A | 9/1999 | Wilkins et al. | |
| 5,991,944 | A | 11/1999 | Yang | |
| 6,182,308 | B1 | 2/2001 | Yang | |
| 6,192,535 | B1 | 2/2001 | Warner, Jr. et al. | |
| 6,233,759 | B1 | 5/2001 | Warner, Jr. et al. | |
| 6,247,755 | B1 | 6/2001 | Canna et al. | |
| 6,390,555 | B2 | 5/2002 | Wilkins et al. | |
| 6,418,575 | B1 | 7/2002 | Cheng | |
| 6,430,762 | B1 | 8/2002 | Cheng | |
| 6,526,608 | B1 | 3/2003 | Hsia | |
| 6,539,563 | B1 * | 4/2003 | Hsia | A47D 9/005 5/98.1 |
| 6,550,083 | B1 | 4/2003 | LaMantia | |
| 6,594,840 | B2 | 7/2003 | Tomas et al. | |
| 6,728,980 | B1 | 5/2004 | Chen | |
| 6,735,796 | B2 | 5/2004 | Warner et al. | |
| 6,859,958 | B2 | 3/2005 | LaMantia | |
| 6,948,197 | B1 | 9/2005 | Chen | |
| 7,055,191 | B1 | 6/2006 | Chen | |
| 7,203,981 | B1 | 4/2007 | Cowgill | |
| 7,263,729 | B2 | 9/2007 | Paesang et al. | |
| 7,346,943 | B2 | 3/2008 | Chen | |
| 7,455,353 | B2 | 11/2008 | Favorito et al. | |
| 7,458,114 | B2 | 12/2008 | Troutman | |
| 7,581,269 | B2 | 9/2009 | Chen et al. | |
| 7,908,686 | B2 | 3/2011 | Clapper et al. | |
| 8,316,481 | B2 | 11/2012 | Arnold et al. | |
| 8,522,374 | B2 | 9/2013 | Sousa et al. | |
| 2002/0078499 | A1 | 6/2002 | Cheng | |
| 2002/0092094 | A1 | 7/2002 | Welsh, Jr. | |
| 2002/0104161 | A1 | 8/2002 | Kuo | |
| 2002/0117520 | A1 | 8/2002 | Chen et al. | |
| 2002/0152550 | A1 | 10/2002 | Tharalson et al. | |
| 2002/0166169 | A1 | 11/2002 | Longenecker et al. | |
| 2003/0046761 | A1 | 3/2003 | Hsia | |
| 2003/0057744 | A1 | 3/2003 | Wilkins et al. | |
| 2003/0070229 | A1 | 4/2003 | Hsia | |
| 2003/0070230 | A1 | 4/2003 | Hsia | |
| 2003/0177575 | A1 * | 9/2003 | Cheng | A47D 13/063 5/93.1 |
| 2005/0005362 | A1 | 1/2005 | Verbovszky | |
| 2005/0150053 | A1 | 7/2005 | Hartenstine | |
| 2005/0253432 | A1 | 11/2005 | Flanagan | |
| 2005/0262628 | A1 | 12/2005 | Tharalson et al. | |
| 2006/0080776 | A1 * | 4/2006 | Clapper | A47D 7/04 5/655 |
| 2006/0130237 | A1 | 6/2006 | Clapper et al. | |
| 2006/0207023 | A1 | 9/2006 | DeHart et al. | |
| 2006/0218725 | A1 * | 10/2006 | Carpenter | A47D 7/04 5/95 |
| 2006/0225204 | A1 | 10/2006 | Bretschger et al. | |
| 2006/0225205 | A1 | 10/2006 | Troutman | |
| 2006/0236454 | A1 | 10/2006 | Chen | |
| 2006/0253980 | A1 | 11/2006 | Paesang et al. | |
| 2007/0061961 | A1 * | 3/2007 | Shamie | A47D 9/016 5/93.1 |
| 2008/0086813 | A1 | 4/2008 | Chen | |
| 2008/0224515 | A1 | 9/2008 | Cui et al. | |
| 2008/0271243 | A1 | 11/2008 | Burkholder et al. | |
| 2008/0313812 | A1 | 12/2008 | Reeves et al. | |
| 2009/0077739 | A1 | 3/2009 | Mendes et al. | |
| 2009/0077740 | A1 | 3/2009 | Jackson et al. | |
| 2009/0113622 | A1 | 5/2009 | Hartenstine | |
| 2009/0113624 | A1 | 5/2009 | Tuckey | |
| 2009/0193582 | A1 | 8/2009 | Kummerfeld et al. | |
| 2010/0138991 | A1 * | 6/2010 | Hartenstine | A47D 7/04 5/99.1 |
| 2010/0162484 | A1 | 7/2010 | Thomas et al. | |
| 2013/0198951 | A1 | 8/2013 | Arnold et al. | |
| 2014/0359938 | A1 | 12/2014 | Burns et al. | |

FOREIGN PATENT DOCUMENTS

| | | | |
|---|---|---|---|
| EP | 0288047 | B1 | 11/1990 |
| EP | 0534215 | A1 | 3/1993 |
| FR | 2550929 | A1 | 3/1985 |
| GB | 2152813 | A | 6/1988 |
| GB | 2365334 | B | 9/2003 |

OTHER PUBLICATIONS

Owner's Manual, Graco Pack N' Play Playard with Newborn Napper, www.gracobaby.com (Oct. 2008).

European Search Report issued in EP Application No. 08251608.9, dated Aug. 28, 2008.

Product Information, Fisher-Price Baby Papasan Infant Seat, www.fisher-price.com (2008).

Product Information, Fisher-Price Baby Papasan Infant Seat, www.fisher-price.com (2007).

Jiangsu Guotai International Group Co. Ltd. (Shenzhen), Baby Playpen, www.alibaba.com (2005).

Century Playard with Bassinet/Changer Instruction Manual, "Fold-n-Go Care Center" (Jun. 2000).

Photograph of Century Products' Crib Cuddle II.

ASTM International, Standard Consumer Safety Specification for Baby Changing Tables for Domestic Use, pp. 1-7.

ASTM International, Standard Consumer Safety Specification for Bassinets and Cradles, 2005, pp. 1-6.

(56) References Cited

OTHER PUBLICATIONS

ASTM International, Standard Consumer Safety Specification for Non-Full-Size Baby Cribs/Play Yards, 2005, pp. 1-21.

* cited by examiner

CHILD CONTAINMENT SYSTEM WITH MULTIPLE INFANT SUPPORT MODES

CROSS-REFERENCE TO RELATED APPLICATIONS

This application is a continuation of U.S. patent application Ser. No. 15/816,628 know U.S. Pat. No. 11,013,345), filed on Nov. 17, 2017, which is a continuation of U.S. patent application Ser. No. 15/613,593 (now U.S. Pat. No. 9,861,209), filed on Jun. 5, 2017, which is a continuation of U.S. patent application Ser. No. 15/237,094 (now U.S. Pat. No. 9,706,855), filed on Aug. 15, 2016, which is a continuation of U.S. patent application Ser. No. 14/313,643 (now U.S. Pat. No. 9,414,694), filed on Jun. 24, 2014, which is a continuation of U.S. patent application Ser. No. 13/682,241 (now U.S. Pat. No. 8,893,325), filed on Nov. 20, 2012, which is a continuation of U.S. application Ser. No. 12/724,283 (now U.S. Pat. No. 8,316,481), filed on Mar. 15, 2010, which claimed priority to U.S. Provisional Application No. 61/159,991, filed Mar. 13, 2009 all of which are incorporated by reference herein in their.

BACKGROUND OF THE DISCLOSURE

Field of the Disclosure

The present disclosure is generally directed to juvenile products, and more particularly to child containment systems for infants.

Description of Related Art

Playards and other child containment structures typically have a frame structure supporting a fabric enclosure and defining a play or sleeping surface at the bottom of the structure. The side walls of a playard are typically rather tall to contain a child or toddler within the playard as the child sleeps or plays. A toddler can stand up so that a caregiver can grasp and lift the child out of the playard without having to reach over the side walls all the way down to the bottom surface. For newborns and infants, using the standard playard bottom surface for a napping or sleeping apparatus is less convenient because the infant cannot stand up. Consequently, the caregiver is forced to reach over the side wall all the way down to the bottom playard surface to place the infant in, or to retrieve the infant from, the playard. These steps are often difficult and strenuous for many caregivers.

Sleeping devices for infants have been configured in the form of bassinets that can be suspended from the top rails of a playard frame structure above the playard's bottom surface. However, this type of bassinet is typically a rectangular box shape, which does not provide a particularly soothing or comforting sleeping environment for newborns and infants. One example of this type of bassinet has a plurality of elongate hooks or clips that have an inverted U-shape in cross section and that are hooked onto and hang from the top rails of the playard frame structure. The box-shaped bassinet bed then hangs from the clips. Changing table devices are also known that are mountable to the playard frame, some in a manner similar to the bassinet, and that provide an area for diaper changing.

An infant sleeping device produced by Fisher-Price has a sleeping surface supported by a discrete frame that sits on the ground. The resting or sleeping surface of the device has a substantial incline and thus requires a harness to secure the child in place. Also, this sleeping device places the sleeping surface, and thus the infant, near the ground, thereby requiring the caregiver to bend over significantly to place the child in or retrieve the child from the device. This device is substantially similar to an infant bouncer seat.

In another example, an apparatus is known that includes a soft material providing a hammock-like sleeping surface that has tie or strap connectors disposed about its periphery. The connectors can be attached, for instance, to the top rails of a crib. However, the connectors require that portions of the top rail periphery on the crib be entirely unobstructed around the rails' circumference because the connectors must loop around the crib rails. A typical playard has fabric suspended from the frame structure obstructing its top rails. As a result, this known apparatus is not suitable for use on a playard. Installation of this hammock-like sleeping apparatus can also take significant time and effort because each individual connector must be individually wrapped around the rail and attached separately. In addition, there are no end connectors to further stabilize the sleeping surface. The only connectors of this prior known sleeping apparatus are found on the sides of the fabric material.

Caregivers have been known to place an infant into a bouncer seat or a car seat, secure the infant in the seat, and then place that seat into the playard for a more comforting or soothing sleeping or napping environment. The bodily movement required of the caregiver can be cumbersome, difficult, and even risk injury. The seat must be placed on the bottom surface of the enclosure or playard structure, which can be cumbersome and place undue stress on the caregiver's back, particularly if the infant is already secured in the seat.

SUMMARY OF THE DISCLOSURE

In one example according to the teachings of the present invention, a child containment system includes a child containment structure, a bassinet, and an infant support unit. The child containment structure has a bottom and a perimeter wall surrounding the bottom. The bassinet has an infant support surface and a surrounding wall around the infant support surface. The bassinet is mounted to the child containment structure with the infant support surface elevated above the bottom of the child containment structure. The infant support unit has a frame, a bed supported by the frame, and a connector structure positioned adjacent each opposed end of the infant support unit. The infant support unit is configured for use in a first operational mode in which the infant support unit is removably mounted to the child containment structure with the bed overlying the infant support surface of the bassinet with each connector structure of the infant support unit coupled to a corresponding portion of the perimeter wall of the child containment structure. The frame is configured to support the bed above a rest surface in a second operational mode in which the infant support unit is detached from the child containment structure.

In one example, the bassinet can be mounted to the child containment structure via clips that engage the perimeter wall of the child containment structure.

In one example, the bassinet can be mounted to the child containment structure via clips that engage the perimeter wall of the child containment structure. Each connector structure can include a frame support coupled to the frame at the respective opposed end of the infant support unit. When the infant support unit is in the first operational mode, each frame support can engage a corresponding one of the clips.

In one example, the bassinet can be mounted to the child containment structure via clips that engage the perimeter wall of the child containment structure. Each connector structure can include a frame support coupled to and extending downward from the frame at the respective opposed end of the infant support unit. When the infant support unit is in the first operational mode, each frame support can rest on a corresponding one of the clips.

In one example, the bassinet can be mounted to the child containment structure via clips that engage the perimeter wall of the child containment structure. The clips can be positioned on a top edge of the surrounding wall of the bassinet and hook onto top rails of the child containment structure and suspend the bassinet within the child containment structure.

In one example, each connector structure can include a frame support coupled to the frame at the respective opposed end of the infant support unit. When the infant support unit is in the first operational mode each frame support can engage the corresponding portion of the perimeter wall of the child containment structure.

In one example, each connector structure can include a frame support coupled to and extending downwardly from the frame at the respective opposed end of the infant support unit. When the infant support unit is in the first operational mode each frame support can be configured to rest on a corresponding portion of the perimeter wall of the child containment structure.

In one example, the child containment structure can include a pair of corner posts extending upward along the perimeter wall. Each corner post of the pair of corner posts can have a receptacle. Each connector structure can include a post connector removably coupled to the frame. When the infant support unit is in the first operational mode each post connector can be inserted into a corresponding one of the receptacles of the pair of corner posts.

In one example according to the teachings of the present invention, a child containment system includes a child containment structure, a bassinet, and an infant support unit. The child containment structure has a bottom surface and a frame structure surrounding the bottom surface. The bassinet has a bottom panel and a surrounding wall around the bottom panel. The bassinet is mounted to the frame structure with the bottom panel elevated above the bottom surface. The bassinet is mounted to the frame structure via mounting clips that engage the frame structure. The infant support unit has a frame, a bed supported by the frame, and a connector part positioned adjacent each opposed end of the infant support unit. The infant support unit is configured for use in a first operational mode in which the infant support unit is removably mounted to the child containment structure with each connector part coupled to a corresponding one of the mounting clips on the frame structure such that the bed overlies the bottom panel. The frame is configured to support the bed above a rest surface in a second operational mode in which the infant support unit is detached from the child containment structure.

In one example, the mounting clips can be positioned on a top edge of the surrounding wall of the bassinet and hook onto top rails of the child containment structure and suspend the bassinet within the child containment structure.

In one example, each connector part can include a clip coupled to the frame at the respective opposed end of the infant support unit. When the infant support unit is in the first operational mode each clip can engage the corresponding one of the mounting clips on the frame structure.

In one example, each connector part can include a clip coupled to the frame at the respective opposed end of the infant support unit. When the infant support unit is in the first operational mode each clip can engage the corresponding one of the mounting clips on the frame structure. When the infant support unit is in the first operational mode each clip can extend downwardly from the frame and rest on a top of the corresponding one of the mounting clips on the frame structure.

In one example, each connector part can include a connector clip coupled to the frame at the respective opposed end of the infant support unit. When the infant support unit is in the first operational mode each connector clip can fit over a top of the corresponding one of the mounting clips on the frame structure.

In one example, each connector part can include a mounting hook coupled to and extending downwardly from the frame at the respective opposed end of the infant support unit. When the infant support is in the first operational mode each mounting hook can hook onto a top of the corresponding one of the mounting clips on the frame structure.

In one example, the frame structure of the child containment structure can include a pair of corner posts extending upwardly from the bottom surface. Each corner post can have a receptacle. The infant support unit can include a pair of post connectors removably coupled to the frame. When the infant support unit is in the first operational mode each of the pair of post connectors can extend into a corresponding one of the receptacles of the pair of corner posts.

In one example, each of the pair of post connectors can be detached from the frame of the infant support when the infant support unit is in the second operational mode.

In one example according to the teachings of the present invention, a child containment system includes a child containment structure, a bassinet, and an infant support unit. The child containment structure has a bottom surface and a frame structure surrounding the bottom surface. The frame structure includes a pair of corner posts that extend upward relative to the bottom surface. Each corner post of the pair of corner posts has a receptacle formed into a top end of the respective corner post of the pair of corner posts. The bassinet has a bottom panel, a surrounding wall around the bottom panel, and mounting clips on the surrounding wall. The mounting clips engage parts of the frame structure of the child containment structure such that the bottom panel is elevated above the bottom surface of the child containment structure. The infant support unit has a frame, a bed supported by the frame, a pair of post connectors coupled to the frame, and a clip connector positioned near each opposed end of the infant support unit. The infant support unit is removably mountable to the child containment structure with each post connector inserted into a corresponding one of the receptacles and each clip connector coupled to a corresponding one of the mounting clips such that the bed overlies the bottom panel of the bassinet.

In one example, the child containment structure can be a playard. The mounting clips can be positioned on a top edge of the surrounding wall of the bassinet and hook onto top rails of the frame structure of the playard and suspend the bassinet within the playard.

In one example, each connector clip can include an underside shaped to rest on the corresponding one of the mounting clips when the infant support unit is in the first operational mode.

BRIEF DESCRIPTION OF THE DRAWINGS

Objects, features, and advantages of the present invention will become apparent upon reading the following description in conjunction with the drawing figures, in which like reference numerals identify like elements in the figures.

DETAILED DESCRIPTION OF THE DISCLOSURE

Figure 1:
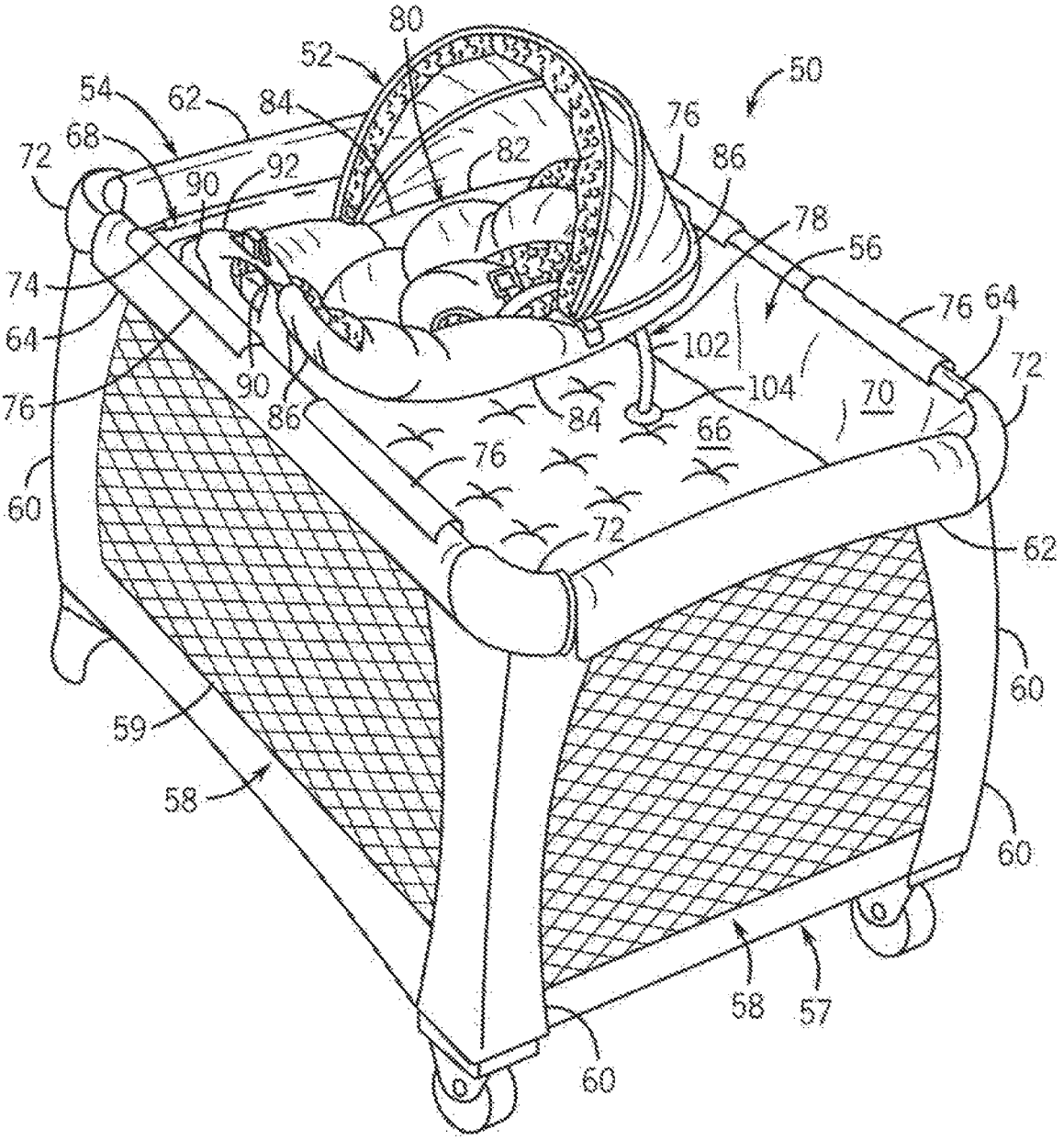
FIG. 1 is a perspective view of one example of a child containment system constructed in accordance with several aspects of the disclosure and assembled for use in a coupled or mounted infant support mode of operation.

The disclosure is generally directed to child containment systems and juvenile products having an infant support apparatus or unit for soothing, sleeping, transport, entertainment, or other activities. The disclosed child containment systems are generally capable of reconfiguration into multiple operational modes or orientations involving a removable infant support unit or apparatus, such as an infant car seat carrier, rocker, bouncer, swing seat, or other infant carrier or product. The disclosed systems generally include a child containment structure, such as a playard, a bassinet, or a bassinet-playard combination. The operational modes or orientations of the child containment system generally involve either coupling one or more infant support units or products to the child containment structure or use of the infant support unit independently of the child containment structure. For instance, an infant support unit may be mounted, supported, or otherwise coupled to the child containment structure for use as a fully assembled system. The same infant support unit may also be used, in a self-supporting manner, separately from the child containment structure in an independent mode, or a non-mounted or uncoupled orientation. The disclosed systems may have operational modes or system configurations beyond those involving the infant support unit, such as a bassinet mode, a changing table mode, etc.

The infant support unit may be generally configured for self-supporting use as an independent unit as, for example, a bouncer, rocker, car seat, or other discrete infant carrier or product. To that end, the infant support units disclosed herein generally include a frame or other structural component(s) that forms a base, foundation, stand, or other structure to allow the unit to stand upright on a level surface. In this way, the unit or apparatus may be placed on a variety of surfaces when not engaged with the child containment structure. Alternatively or additionally, the frame or other structural component(s) may also be configured to allow the unit to engage another juvenile product, such as an infant swing, an infant car seat (or base unit thereof), or a bouncer.

Several aspects of the disclosed child containment systems and support units thereof provide caregivers with a safe, soothing product solution well-suited for the newborn phase of infancy. Generally speaking, the infant support products may be easily mounted, connected, or otherwise coupled to a child containment structure, such as a bassinet, a playard, or a playard with or without a bassinet unit integrated therewith, and then easily disconnected and used as an independent or discrete unit of the system. In this way, caregivers can use the independent unit as necessary to transport, soothe, or entertain the infant, and then avoid having to remove the infant from the unit before secure placement into the playard or other containment structure. Because the independent unit may correspond with a bouncer, rocker, car seat, or other infant support apparatus frequently used by the caregiver, caregivers avoid having to place bouncers, car seats, or other products into the child containment structure that are incompatible therewith and, thus, unsecured or otherwise unsafe.

Although described below in connection with a soothing juvenile product such as a rocker or hammock-like bed or cradle, the disclosed systems may include and be compatible with a variety of different juvenile products. As a result, the nature of the independent operational modes may vary with the configuration of the infant support unit. The infant support apparatus or unit may be or include a bed, cradle, bouncer, car seat carrier, swing seat, or other apparatus designed to support an infant in a comfortable, soothing, sleep-promoting, safe, or other positive manner. Examples involving rockers, swing seats, and bouncers are all addressed in the embodiments described and shown herein. In each of these examples, the unit may be easily connected with a bassinet, playard, bassinet/playard combination, or other containment structure in a secure and engaged manner, and then disconnected for use as an independent unit. The caregiver can then easily switch between the two modes of operation without having to remove the infant from the unit.

In some cases, the disclosed infant containment systems include one or more infant support units configured to provide a hammock-shaped sleeping or soothing area for a child. To that end, soft goods or other fabric materials may be suspended from a frame assembly that may also support the sleeping area above a rest surface when used in the independent mode. In some cases, the frame assembly of the infant support unit is also utilized for engagement with the infant containment structure.

The infant support unit is configured for convenient caregiver attachment and detachment to the child containment structure, which may be, for instance, a playard or playard/bassinet combination. Some of the challenges addressed by the disclosed systems involve enabling convenient attachment while not rendering it simple or easy for another child to disengage, tip, or otherwise move the unit. For example, each handle of the infant support unit may include a release mechanism for detaching the unit from the child containment structure. The location of the release mechanism on the handle enables the caregiver to release and raise each respective side of the infant support unit with a single hand in a convenient manner. Nevertheless, disconnecting the infant support unit may be made difficult for a child because it involves simultaneous engagement of multiple release mechanisms, which may be spaced sufficiently apart by positioning each handle on a respective end of the unit.

The engagement of the unit and containment structure may involve the unit hanging from, or otherwise engaging, a frame rail or other structural component of the system. The disclosed systems address the challenge of enabling such engagement without leaving any suspended bars or other supports hanging within the interior space of the playard or bassinet when either the unit or the bassinet is detached. In some of the examples shown, the couplers are configured to engage a slot, groove, or other receptacle formed in or on a component of the containment structure. In some cases, the coupler engages a pocket or slot formed in a panel supported by a frame rail. The panel and the pocket need not be formed from soft goods, as shown. Other cases may utilize a slot or receptacle formed in a clip, sleeve, or other overlay that engages the frame rail. Still other cases present alternatives to the receptacle-based engagement that instead use a bracket or hook to hang the unit from the frame rail.

Turning now to the drawing figures, FIG. 1 depicts a child containment system 50 constructed in accordance with several aspects of the disclosure. The system generally includes an infant support apparatus or unit 52 mounted to and supported by a playard 54 and directly above a bassinet 56 installed on the playard. As is known in the art, the playard 54 has a bottom as part of a base structure 57 that creates a play or sleeping surface surrounded by side walls 58. Together, the base structure 57, the side walls 58, and other components of the playard 54 provide at least part of a child containment structure that defines a child containment enclosure for an infant or toddler. The playard 54 may be conventionally configured and constructed.

The side walls 58 of the playard 54 are generally formed of a fabric and mesh material 59 suspended from and supported by top rails of a frame structure. In the disclosed example, the frame structure of the playard 54 is rectangular and has four corner posts 60 extending upward from the base structure 57 at corners of the playard. A top end rail 62 is positioned interconnecting the corner posts 60, near their respective top ends, at each opposite end of the playard 54. Similarly, a top side rail 64 is positioned interconnecting the corner posts 60, near their respective top ends, along the opposed sides of the playard. As will be evident to those having ordinary skill in the art, the frame structure and overall configuration of the playard 54 described herein may vary from the example shown. The disclosed infant sleeping apparatus 52 may thus vary according to changes and modifications made to the child containment structure or playard with which the apparatus is intended to be used.

The bassinet 56 may also be constructed in a conventional manner. In this example, the bassinet 56 generally has a bottom panel 66 creating an infant support surface. The bottom panel is surrounded by a perimeter side wall that has a pair of opposed end panels 68 and a pair of opposed side panels 70. In the disclosed example, the bassinet 56 is sized essentially to fit the interior of the playard 54. The side panels 70 and end panels 68 thus are generally flush against or adjacent the interior surfaces of the side walls 58 of the playard 54. The side and end panels 70, 68 of the bassinet 56 are significantly shorter than the side walls 58 of the playard 54. As a result, the bottom panel 66 is elevated to form a shelf above the bottom of the base structure 57 when installed.

In this example, the playard 54 has a turnbuckle or bracket 72 positioned on each corner post 60 and adjoining the top end and top side rails 62, 64. Each end panel 68 of the bassinet 56 includes a fabric tunnel or channel at the top of the panel. A support rod 74 is received through each of the channels. When the bassinet 56 is installed, the ends of the rod 74 are exposed beyond the fabric channels on each end of the bassinet. The exposed ends of each rod 74 are inserted in receptacles, one in each bracket 72 on each end of the playard 54. A number of mounting clips 76 are carried on the top edges of the side panels 70 of the bassinet 56. The mounting clips 76 in this example are generally elongate, inverted U-shaped hooks that are formed of plastic and sewn to the top edges of the side panels 70. As generally shown, the mounting clips 76 attach to or hook onto the top side rails 64 of the playard 54. When installed, the bassinet 56 is supported around its perimeter by the rods 74 and the mounting clips 76. Further details regarding the installation, configuration, and construction of the bassinet 56 are set forth in co-pending and commonly assigned U.S. patent application Ser. No. 12/113,552, entitled "Infant Sleeping Apparatus and Child Containment System," which was filed on May 1, 2008, and published on Nov. 8, 2008, as U.S. Patent Publication No. 2008/0271243, the entire disclosure of which is hereby incorporated by reference.

As will become evident to those having ordinary skill in the art upon reading this disclosure, the devices and methods used to install the bassinet 56 on the playard 54 may vary considerably. For instance, the number, arrangement, positioning, and configuration of the mounting clips 76 and the rods 74 may vary from the examples shown. While the clips 76 in this example are sewn to the bassinet panels, the clips 76 or other attachment devices may be secured to or integrated with the bassinet 56 in other ways. Instead of being removable from the channels in the end panels 68 on the bassinet, the rods 74 may be fixed to the bassinet or may be replaced by other attachment devices at the corners and/or on the end panels 68. The structure and configuration of the bassinet 56 may also vary from that shown. In the disclosed example, the bottom panel 66 and the side and end panels 70 and 68 are formed of a flexible fabric material, may include a stiffening panel, and may include a mattress separate from the stiffening panels. Stiffeners, padding, and other features may be added to the bassinet side wall panels and sleeping surface, if desired. Also, a mesh material may be added strategically at locations on the bassinet to provide air flow to the sleeping surface, to effect weight reduction, and the like.

The disclosed child containment systems are generally well suited for use throughout a range of child ages and developmental periods. During the infancy period, the system 50 may be used in the fully coupled (or assembled) mode shown in FIG. 1, in which the bassinet 56 is coupled to the playard 54, and the infant support unit 52 is coupled to the bassinet 56 as described below. The system 50 is also well suited for infants when the infant support unit 52 is removed from the bassinet 56. The child may be placed on the mattress of the bassinet 56, as well as on the unit 52 during self-supported, or independent use as described below. The playard 54 is then well suited for use without the bassinet 56 after the child has grown out of the infancy phase. Thus, the adaptability of the system 50 includes or involves the selective coupling (and decoupling) of system components or units, e.g., the infant support unit 52 and the bassinet 56, to the playard 54. Further details regarding the conversion or adaptation of the playard 54 or other exemplary infant containment structures are set forth in the above-referenced U.S. patent application.

Figure 4:
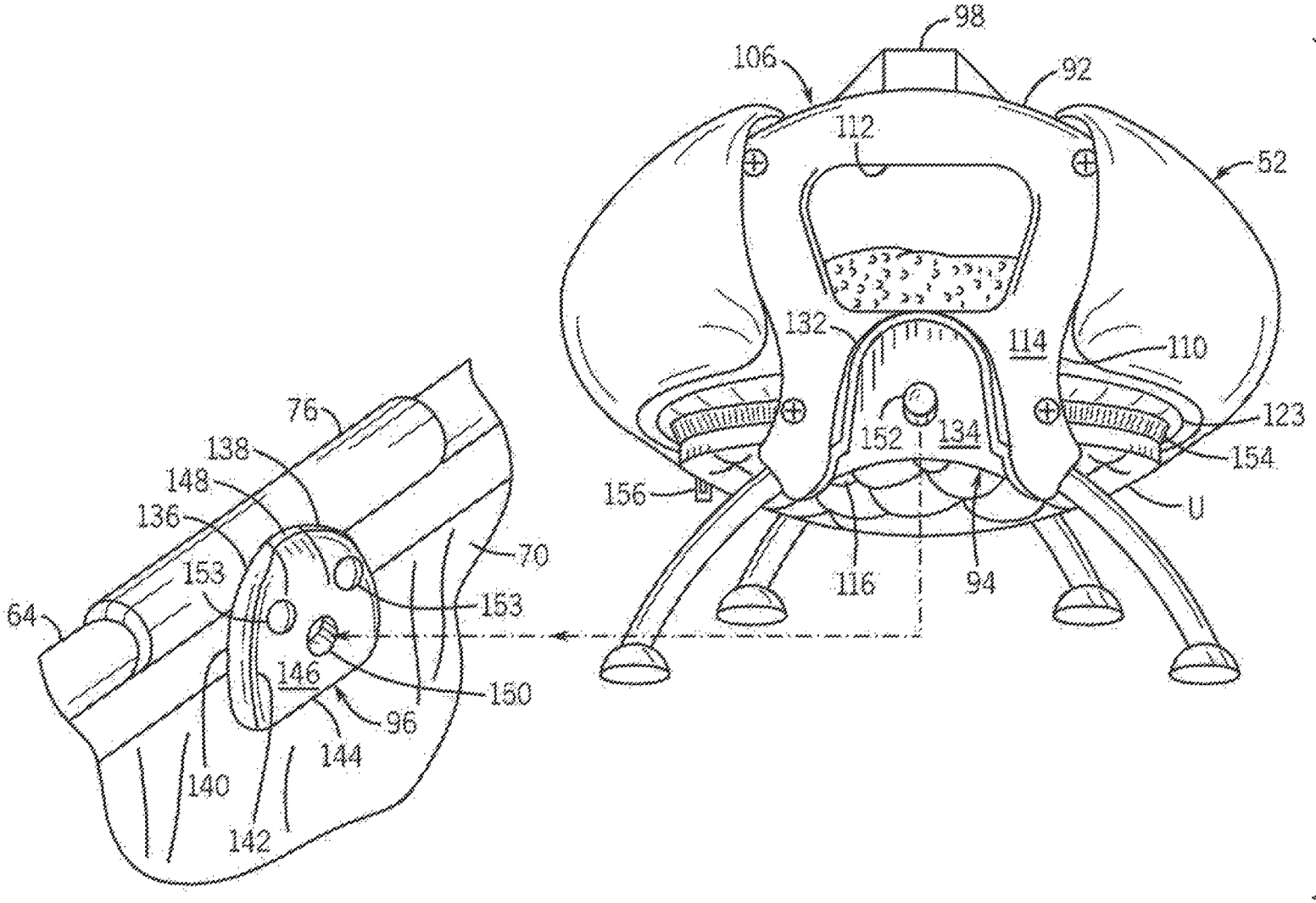
FIG. 4 is an exploded, perspective view of the child containment system of FIG. 1 to show one example of a mount on which the infant support unit of FIG. 3 is seated in the coupled infant support mode of operation.

The infant support unit 52 has a frame assembly 78 that generally supports a fabric bed 80. Together, the frame assembly 78 and the fabric bed 80 define a perimeter 82 of the unit 52. Within the perimeter 82, the fabric bed 80 has a top side or sleeping surface S (FIG. 2) and a bottom side or underside U (FIG. 4). The perimeter 82 includes a pair of opposed sides 84 that extend lengthwise between a pair of opposed ends 86. A fabric tunnel or channel 88 may be formed along each side 84 of the perimeter 82 on the underside U of the fabric bed 80 to accommodate tubing or other components of the frame assembly 78, several examples of which are described below. In this example, the fabric channels 88 terminate at open ends 90 near each end 86 where handles 92 are exposed for a user to grasp when transporting or manipulating the unit 52. As described below, the handles 92 assist the caregiver in lifting and moving the infant support unit 52 into and out of the playard 54 during transitions between the operational mode shown in FIG. 1 and, for instance, another mode of operation in which the unit 52 is detached from the playard 54.

The infant support unit 52 generally provides a sleeping area for an infant that can be positioned within and supported by the playard 54. The unit 52 is generally configured to snuggly envelop a newborn or infant, similar to a hammock, to create a comforting "womb-like" environment for napping or sleeping. An infant sleeping in the bed 80 of the unit 52 will tend to be centered in the middle of the bed and enveloped by the fabric material of the bed. The fabric may be sized to sag or droop in the middle, and particularly with the weight of an infant placed on the surface S. The infant support unit 52 in this example can thus provide a soothing and comforting sleeping environment for an infant that will cradle the infant, thereby inducing sleep. Because the unit 52 can mount to the bassinet 56 that has already been installed on the playard 54, the sleeping surface of the bassinet 56 beneath the unit 52 creates a "safety net" directly beneath the napping or sleeping surface of the unit 52.

In accordance with several aspects of the disclosure, the infant support unit 52 is configured such that the availability of a safe and soothing sleeping or napping area is not limited to the playard 54 or the bassinet 56. The unit 52 can instead provide a soothing, enveloping or womb-like environment for infants through multiple operational modes of the system 50. For example, the operational modes of the system 50 may include the coupled mode of operation shown in FIG. 1 as well as an independent mode in which the unit 52 is decoupled from the playard 54 and the bassinet 56. As a result, the benefits of the soothing, enveloping, or womb-like environment are greatly enhanced with the disclosed systems because the caregiver can attach and detach the unit 52 while the infant is sleeping. In this way, the caregiver can transition between the operational modes without waking or disturbing the infant.

Certain aspects of the unit 52 that enable independent use as well as easy transitions between the operational modes present some of the challenges addressed by the disclosed systems. For example, the unit 52 is configured to avoid the creation of unsafe conditions within the playard 54 despite the presence of structural aspects of the frame 78 that enable independent use. Aspects of the mounting arrangement are also directed to a secure, safe attachment to the playard 54 while nonetheless rendering attachment and detachment convenient, simple, and smooth (e.g., to minimize infant disturbance) for the caregiver, but not so simple or easy for a child. These and other challenges are met while providing a sleeping surface or apparatus that can be readily and easily attached to an existing playard frame or other child containment enclosure or structure, and, in some cases, mounted easily to the top rails of a playard frame or other structure for easy and ready access by a caregiver.

Figure 2:
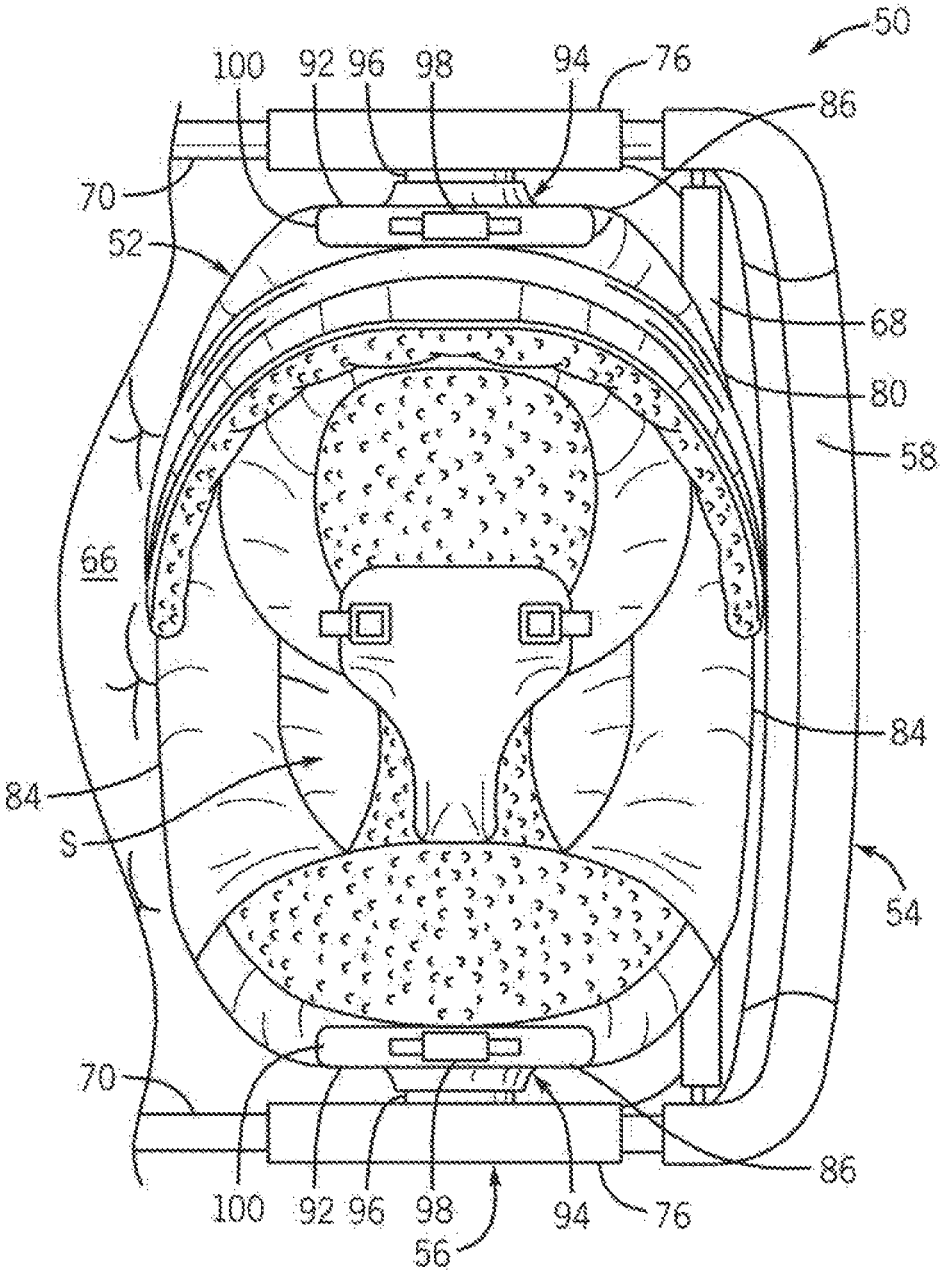
FIG. 2 is a partial, plan view of the child containment system of FIG. 1 to show an infant support unit of the child containment system in greater detail.

With reference now to FIG. 2, the infant sleeping unit 52 is again shown attached to, and supported by, the bassinet 56, which, in turn, is attached to and supported by the playard 54. The combination of the infant sleeping apparatus 52, the playard 54, and the bassinet 56 create an infant sleeping arrangement in accordance with a coupled operational mode of the system 50. Generally speaking, the infant sleeping unit 52 is installed or mounted within the playard 54 and the bassinet 56 using a connector arrangement at or adjacent to each end 86 of the fabric bed 80. In this example, each handle 92 carries or includes a connecting structure 94 to attach the infant support unit 52 to the bassinet 56. Each connecting structure 94 is disposed on an exterior side of the handle 92 to project outward from the end 86 and engage the playard 54 and/or the bassinet 56.

Together, the connecting structures 94 define mounting interfaces for the infant support unit 52 on or along the perimeter 82 of the infant support unit 52. The connecting structures 94 are configured to engage bed connectors or mounts 96 carried on or disposed along interior surfaces of the opposed bassinet side panels or walls 70. In this example, each bed mount 96 projects from one of the bassinet mounting clips 76 on the bassinet side panels 70. The bed mount 96 may be integrally formed with the mounting clip 76 as a one-piece structure, which forces the caregiver to install the bassinet 56 before attempting to couple the unit 52 to the playard 54. This requirement avoids misuse scenarios in which the unit 52 is placed upon the playard 52 in an unsafe or inappropriate manner. With the bassinet 56 in place, the bottom panel 66 of the bassinet 56 can then provide additional safeguards during use for the infant. For instance, the bassinet 56 can help deal with instances where an extra load is applied to the unit 52 (i.e., beyond the weight of the infant), as described further below.

In accordance with one aspect of the disclosure, the infant support unit 52 is generally disposed along, and in close proximity to, one or more of the side and end walls of the child containment structure. Positioning the infant support unit 52 in this manner generally prevents an unsafe situation in which, for instance, a child is caught between the unit 52 and some other structural component of the system 50. This situation generally would involve a misuse scenario in which the system 50 is used with another child in the playard 54 or the bassinet 56 while the unit 52 is installed.

In this example, the bed mounts 96 are positioned along the bassinet side panels 70 and the sidewalls 58 of the playard 54 such that the side 84 of the unit 52 is in close proximity to the end walls 58 and 68 of the playard 54 and the bassinet 56, respectively. The position of the bed mounts 96 is generally driven by the position of the bassinet clips 76. As a result, the installation of the bassinet 56 in the playard 54 is generally determinative of the position of the infant support unit 52 relative to the end walls 58, 68. In some cases, a portion of the unit 52 may even extend over the bassinet end wall 68 slightly as shown, although the end wall 68 is shown as spaced inward from the playard end wall 58 in FIG. 2 for ease in illustration.

The sizes and shapes of the infant support unit 52, the connecting structures 94, and the mounts 96 may also be selected to minimize the spacing or gap between the unit 52 and the side walls of the child containment structure. As shown in FIG. 2, the connecting structures 94 and the mounts 96 are configured to introduce minimal spacing between the ends 86 of the unit 52 and the bassinet side panels 70 (and the bassinet clips 76) and the side walls 58 of the playard 54. To that end, both the connecting structures 94 and the mounts 96 may be a thin, plate- or strip-shaped object, or a similarly thin or plate- or strip-shaped receiver. As a result, the width of the connecting structures 94 and the mounts 96 may be greater (or substantially greater) than the depth thereof. To allow the unit 52 to snugly fit between the bassinet side panels 70 and side walls 58 of the playard 54, the connecting structures 94 and the mounts 96 may be larger (or substantially larger) in the lateral dimension (i.e., parallel to the gap) than in the longitudinal dimension that determines the size of the gap. Moreover, the connecting structures 94 and the mounts 96 may largely, if not entirely, overlap in the direction of the gap spacing (i.e., the longitudinal direction of the unit 52). In FIG. 2, the longitudinal extent, or thickness, of the mounts 96 may be exaggerated for ease in illustration relative to the connecting structures 94. In other cases, the mounts 96 may instead be additionally or entirely overlapped by the connecting structures 94 if less spacing from the side panel 70 is desired. As described below, the connecting structures 94 and the mounts 96 may be coupled via a sliding engagement that maximizes overlap and minimizes depth (i.e., gap spacing). The sliding movement generally runs transverse to the gap as the unit 52 is lowered onto the bed mounts 96. Such sliding may be guided by one or more tracks presented by the connecting structures 94, the mounts, 96, or some combination thereof.

Each handle 92 includes a push-button 98 to release and detach the unit 52 from the playard 54 for independent use. The connecting structure 94 is allowed to disengage from the bed connector 96 when the caregiver presses the release button 98. In this example, the release button 98 projects upward from a top side 100 of the handle 92. This location of the release button 98 allows the caregiver to disengage the connecting structure 94 from the bed connector 96 with the same hand that grasps the handle 92 to lift the unit 52 out of the playard 54. This one-hand disengagement also allows the caregiver to disengage and lift both ends of the unit 52 at the same time.

With reference again to FIG. 1, once the connecting structures 94 are coupled to the bed connectors 96, the infant support unit 52 is installed and ready for use within the playard 54 in the coupled operational mode. In this example, the unit 52 is suspended above the bottom panel 66 of the bassinet 56 via the connection between the structures 94 and the connectors 96. That is, the unit 52 may be spaced from the bassinet 56, including any mattress or soft goods thereof, during the coupled operational mode. Both the underside U of the bed 80 as well as the frame 78 of the unit 52 are spaced above the bottom panel 66 of the bassinet 56. However, the bassinet bottom panel 66 is positioned directly below and not far from the unit 52. Thus, an infant that is sleeping on the surface S of the unit 52 would only fall a few inches onto the bassinet 56, if the infant were to fall from the sleeping unit. The bassinet 56 thus acts as a safety net positioned directly beneath the infant support unit 52.

In some cases, the frame 78 of the infant support unit 52 may be configured to approach the bottom panel 66 of the bassinet 56 during the coupled operational mode. As shown in FIG. 1, legs 102 of the frame 78 may terminate in feet 104 that are positioned in close proximity to the bottom panel 66. In fact, the feet 104 may come in contact with the bottom panel 66 (or the soft goods thereof) while the unit 52 is installed. Nonetheless, the frame 78 and other components of the system 50 may be configured to ensure that the weight of the unit 52 is supported by the above-described connection arrangement rather than the bottom panel 66 under normal circumstances. However, the close proximity of the feet 104 and the bottom panel 66 may provide a safeguard against misuse scenarios in which the load applied to the infant support unit 52 exceeds the weight of an infant. In such cases, the frame 78 may deflect under the increased load such that the unit 52 bears upon the bottom panel 66 of the bassinet 56, thereby distributing the increased load over the entire bassinet 56.

Figure 3:
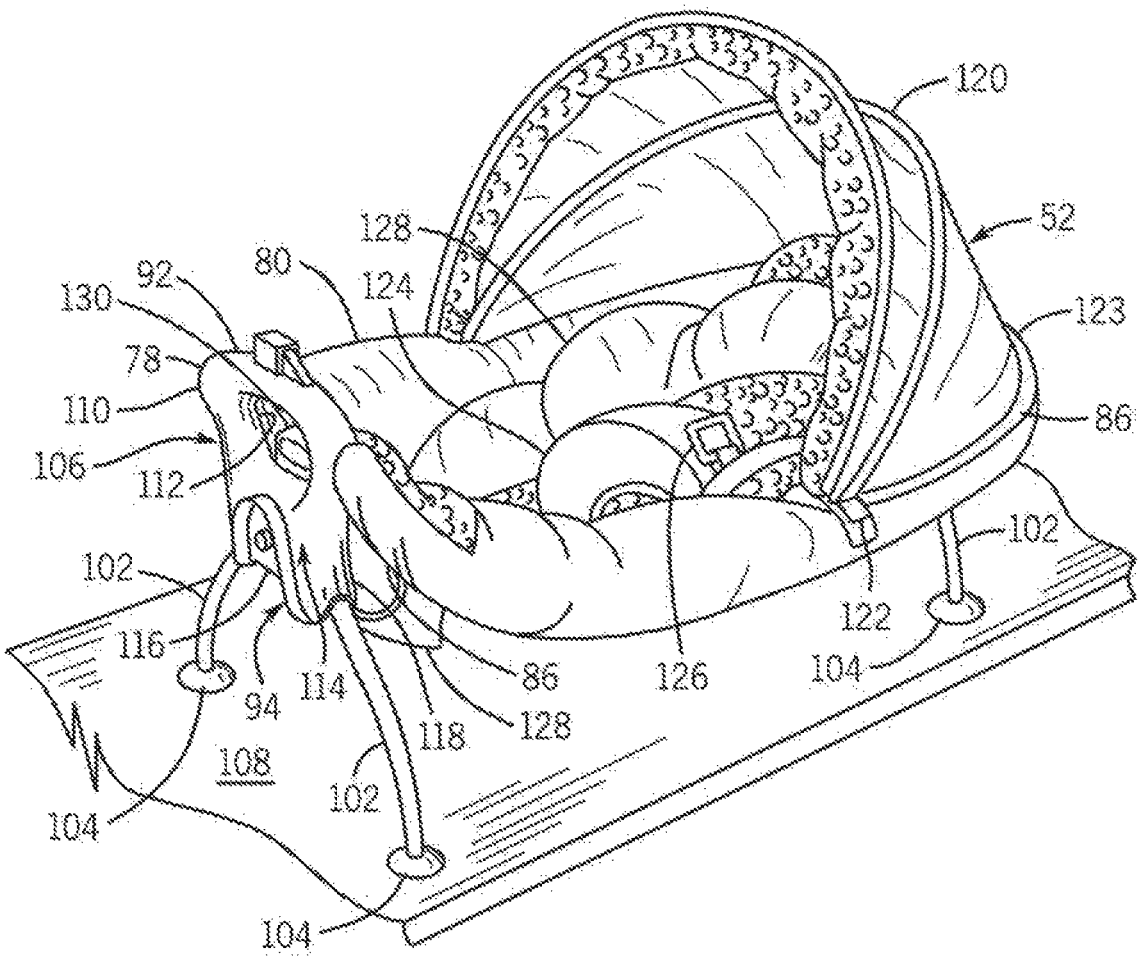
FIG. 3 is a perspective view of the infant support unit shown in FIG. 2 separated from the remainder of the child containment system for use in an independent infant support mode of operation.

Turning now to FIG. 3, several aspects of the disclosure involve another operational mode of the system 50 (FIG. 1) in which the infant support unit 52 is self-supported and, thus, independent from the playard 54 and the bassinet 56. The independent operational mode presents caregivers with the option of transporting an infant resting or sleeping in the unit 52 installed within the playard 54 without removing the infant from the unit 52, thereby avoiding the risk of awakening or otherwise disturbing the infant. Thus, the independent operational mode may provide all the same features and benefits presented by the coupled operational mode, including the soothing, hammock-like environment of the bed 80.

The frame 78 of the infant support unit 52 is generally configured to enable use of the unit 52 in the independent operational mode. In this example, the frame 78 includes a pair of the handle stands 106 that support the bed 80 above a rest surface 108. Each handle stand 106 includes an upright, rigid structure located at one of the ends 86 of the unit 52. Each handle stand 106 includes a housing 110 that forms the handle 92 and captures the legs 102, which project downwardly and laterally outwardly from the housing 110. The handle 92 is presented by a central hole or pass-through 112 in the housing 110. As a result, an upper section of the housing 110 has a toroidal shape in this case. The connecting structure 94 projects outward from an exterior face 114 of a lower section of the housing 110 beneath the central hole 112. As described below, the connecting structure 94 is located at or near a lower edge 116 of the handle stand 106 to facilitate engagement with the bed connector 96 (FIG. 2). The handle stand 106 includes a pair of sleeves 118 projecting downward and laterally outward near the lower edge 116 to which the legs 102 are secured. The shape and configuration of the handle stand 106 and the housing 110 may vary considerably from the example shown.

While the housing 110 may be rigid, other components of the frame 78 may be resilient to a desired extent. For example, the legs 102 may be capable of resilient deflection so that the unit 52 can operate as a bouncer in the independent operational mode. In the example shown, each leg 102 has a curvature to promote vertical deflection of the bed 80. More specifically, each leg 102 forms an arch that extends upward and laterally inward from the feet 104 to reach the housing 110. The resilience of the legs 102 may also be useful in connection with a vibration feature of the infant support unit 52. Each foot 104 may be provided with a non-slip base to allow the legs 102 to vibrate or deflect without displacement of the unit 52 along the rest surface 108. The non-slip base may be made of a rubber or rubberized material such as a thermoplastic elastomer (TPE).

The infant support unit 52 may include a number of features to enhance the soothing environment of the bed 80. Each of the features is generally available regardless of the operational mode selected by the caregiver. For instance, the unit 52 may include a canopy 120 that removably and adjustably attaches to the frame 78 via one or more clips 122. The canopy 120 generally extends upward from and covers a head end 123 of the bed 80. The unit 52 may include a three-point or other harness 124 having one or more buckles 126 to secure the infant within the bed 80 during transport or other use of the unit 52. The bed 80 may also include one or more body support panels 128 made of soft goods to envelop or bolster the infant for increased comfort. Blankets or other soft goods (not shown) may also be included and directed to covering the feet of the infant or swaddling the infant. A vibration unit (not shown) may be disposed in a pocket 128 at a foot end of the bed 80 opposite from the head end 123. A vibration unit may be controlled by a switch accessible from the sleeping surface S of the bed 80 via a soft goods flap 130 formed in the bed 80 at the foot end.

FIG. 4 depicts the infant support unit 52 and its engagement with the bed connector 96 in greater detail. The handle stand 106 is shown exploded from the bassinet side panel 70 and oriented to depict the configuration of the connecting structure 94 on the exterior face 114 of the housing 110. In this example, the connecting structure 94 has an outer side with an inverted, U-shaped perimeter wall 132 that surrounds on three sides a generally flat face 134 of the structure. The perimeter wall 132 is open at the bottom of the connecting structure 94 along the lower edge 116 of the housing 110. The sides of the perimeter wall 132 may diverge laterally outward near the lower edge 116 to facilitate and guide the bed connector 96 into the space defined by the perimeter wall 132.

The bed connector 96 in this example includes a mount structure 136 that projects from the exterior but inner facing side of the bassinet clip 76 to define a mounting point for the connecting structure 94. The mount structure 136 may be generally hub-shaped as shown to minimize thickness (e.g., minimize protrusion into the interior space of the bassinet 56) and present generally smooth surfaces and rounded edges as described below. The perimeter wall 132 of the connecting structure 94 and the mount structure 136 have complementary shapes to facilitate a slidable engagement and overlap. To this end, the mount structure 136 has a rounded top 138 and generally linear sides 140. Each linear side 140 may have an inner rounded edge 142 to avoid presenting any sharp corners for a child lying in the bassinet 56 (FIG. 1) with the unit 52 not installed. Similarly, a bottom edge 144 may also be rounded or curved for this purpose. Other edges of the mount structure 136 may also be rounded or smoothed to prevent the formation of a catch or hook upon which an object may be caught.

The mount structure 136 includes a generally flat, inner face 146 that slides against the face 134 of the connecting structure 94. The inner face 146 of the mount structure 136 has a chamfer or ramp 148 disposed at the top edge 138 and a receiver 150 centered within the face 146 beneath the ramp 148. The receiver 150 may be shaped as a detent or hole sized to capture a button, pin, or other projection 152 that extends longitudinally outward from the face 134 of the connecting structure 94. The receiver 150 is positioned along the face 146 such that the button 152 enters and engages the hole when the connecting structure 94 is lowered onto the mount structure 136. Generally speaking, the button 152 can be retracted out of the hole of the receiver 150 by a caregiver pressing on the button 98 to detach the unit 52 from the bassinet 56 (FIG. 1). Further details regarding the operation of the button 152 and the releasable yet secure engagement of the structures 94 and 136 are set forth below.

The mount structure 136 may be fastened to the bassinet clip 76 in a variety of ways. In this example, a pair of rivets 153 may pass through the structure 136 from the front face 146 to attach the seat connector 96 to the bassinet clip 76. Alternatively or additionally, the connector 96 may include a spacer or arm (not shown) projecting from the bassinet clip 76 into the interior of the bassinet 56 to suspend the structure 136 at a position spaced from the bassinet side panel 70.

The head end 123 of the bed 80 is shown in FIG. 4 to reveal a recline feature of the infant support unit 52. The underside surface U of the bed 80 may include a zippered pocket 154 at the head end 123 of the bed 80. A zipper 156 may be used to open the pocket 154 to allow a folded soft good panel (not shown) to expand as the underside surface U falls downward to the extent allowed by the pocket 154. The expanded soft goods effectively lower the floor of the bed 80 near the head end 123. As a result, the elevation of the infant's head decreases accordingly, thereby reclining the infant to a desired extent.

Figure 5:
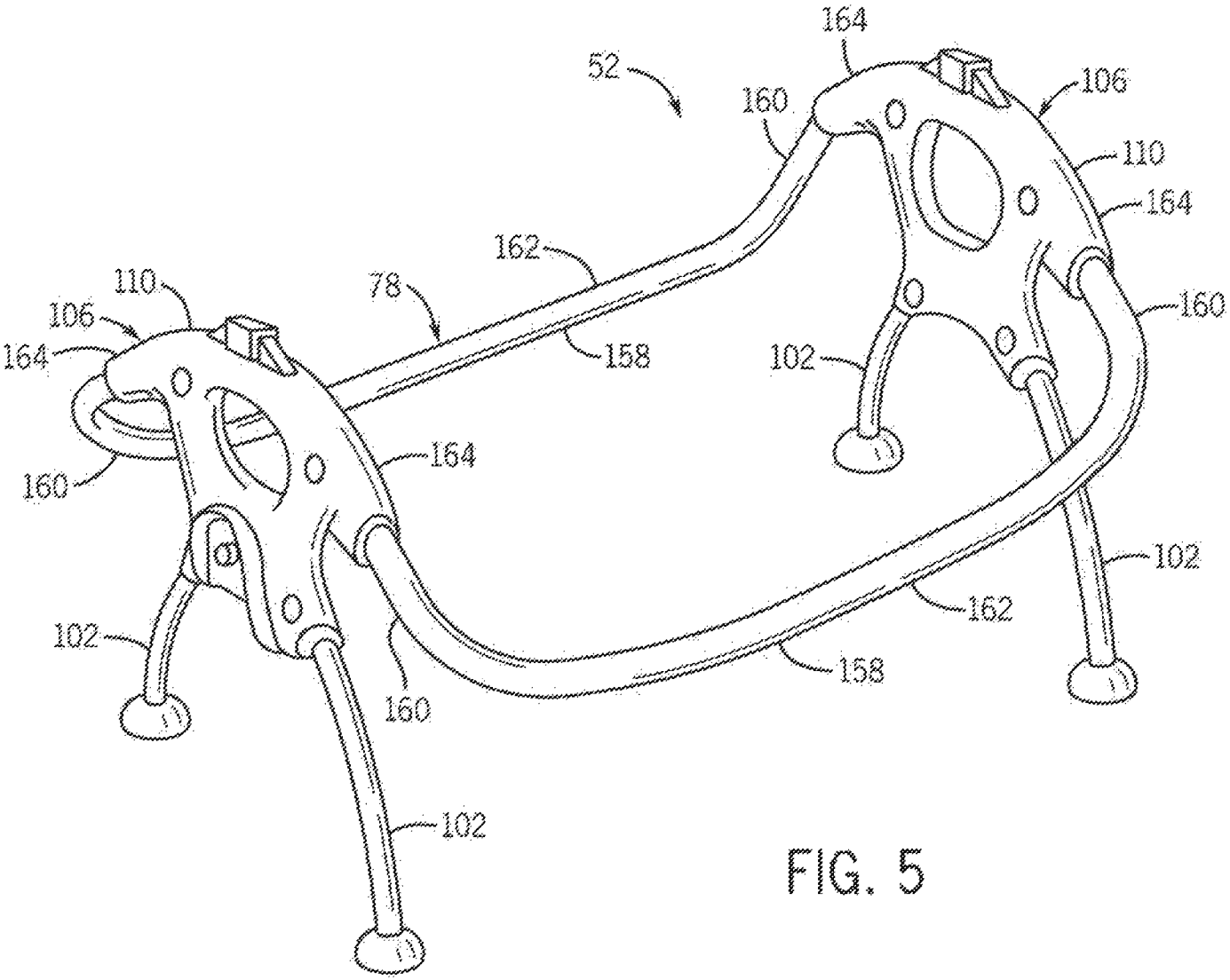
FIG. 5 is a perspective view of the infant support unit of FIG. 3 with soft goods removed to reveal an exemplary frame configured to support the infant above a rest surface in the independent infant support mode of operation.

Turning to FIG. 5, the infant support unit 52 is shown with the fabric bed 80 (FIG. 2) and other soft goods removed to depict the frame 78 in greater detail. In this example, the frame 78 includes a pair of tubes 158 that generally run lengthwise to connect the handle stands 106 and form the hammock-like shape of the bed 80. Each tube 158 includes a pair of end segments 160 that terminate at the housing 110 of the handle stand 106 and a central, generally linear segment 162 extending longitudinally between the pair of end segments 160. Together, the segments 160, 162 form a U-shaped framework for the soft goods that projects laterally outward and downward from the point at which each end segment 160 is secured to the housing 110. Each end segment 160 may be secured to the housing 110 via rivets or other fasteners. The housing 110 may include sleeves 164 that capture the end segments 160 for secure attachment. Each sleeve 164 of the housing 110 may project laterally outward and downward from the top side 100 of the handle 92, thereby orienting each end segment 160 in a similar direction. The length of the end segments 160 determine the extent to which the central tube segments 162 and, thus, the bed 80, are suspended above the bassinet bottom panel 66 in the coupled mode shown in FIG. 1 and the surface on which the unit 52 is placed in the independent mode shown in FIG. 3 (for a given length of the legs 102 of the frame 78). The length of the tubes 158 may be selected to ensure a snug fit within the bassinet 56 as shown and described in connection with FIG. 2.

The tubes 158 may be composed of a variety of plastic materials, or other rigid or semi-rigid materials, to provide structural support for the bed 80. The dimensions, shapes, materials, and other characteristics of the component 78 may vary considerably from the example shown. The location of the handles, stands, or legs may also be modified from the example shown. For instance, an alternative unit may have a pair of stands or legs positioned along the longitudinal sides of the unit rather than the ends. Similarly, the handles may be moved to the longitudinal sides as shown in one of the alternative embodiments described below.

Figure 6:
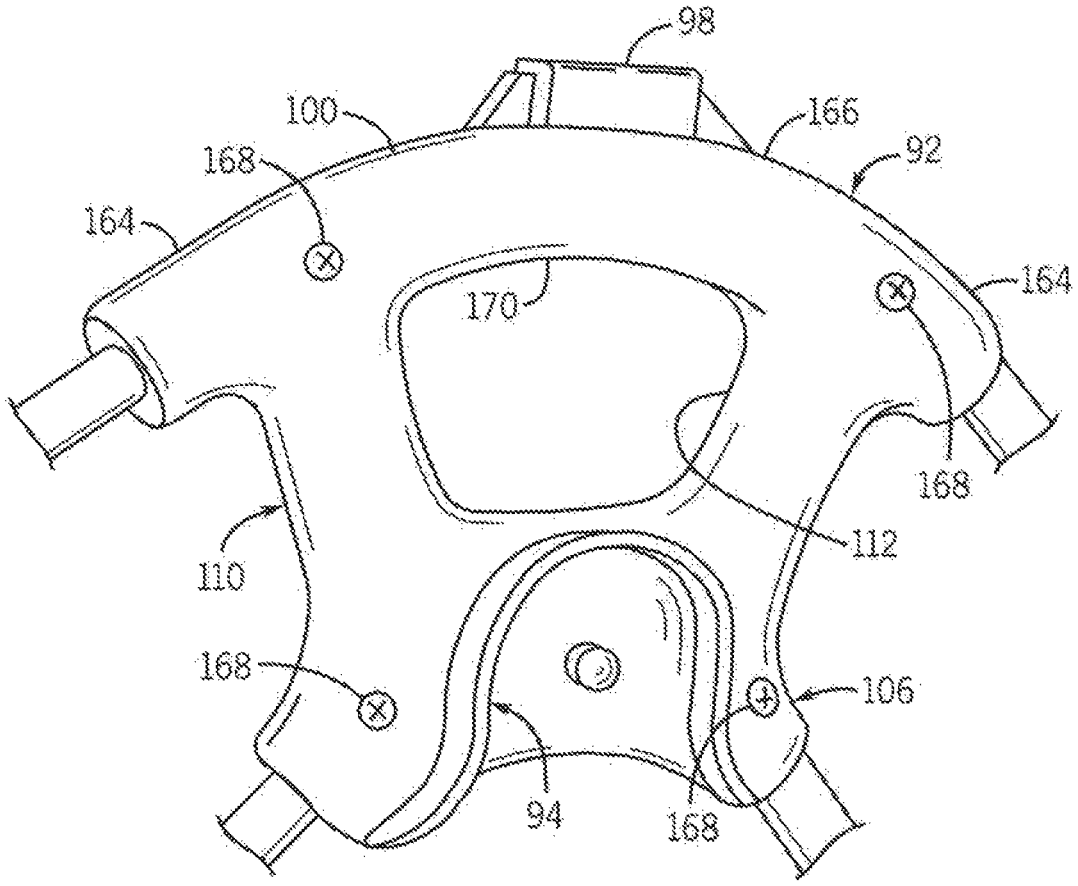
FIG. 6 is a perspective view of one embodiment of a handle stand of the exemplary frame of FIG. 5 constructed in accordance with several aspects of the disclosure.

FIG. 6 shows the handle stand 106 of the frame 78 in greater detail. The handle 92 of the stand 106 includes a bar- or rod-shaped arch 166 that extends along the top side 100 of the handle 92 between the sleeves 164, each of which may be an integral extension of the arch 166. In this case, each of the components of the handle stand 106 are integrally formed via a two-piece mold secured together to form the housing 110. Thus, the housing 110 may include inner and outer clam-shells secured to one another by, for instance, screws 168 or other fasteners.

FIG. 6 also shows how the handle 92 can be grasped by a caregiver while engaging the button 98 on the top side 100 of the handle 92. The hole 112 is generally sized to allow a caregiver's hand to pass through the hole 112 and engage a handgrip surface 170 presented on an upper side of the hole 112 (or a lower side of the arch 166). With the caregiver's hand in that position, the thumb of the hand can be extended upward for positioning on or near the button 98. In this way, the caregiver can use a respective hand to disengage each of the above-described connector arrangements while lifting the unit 52 via the surfaces 170. As a result, disengagement of the unit 52 from the playard 54 (FIG. 1) is convenient and easy for the caregiver. However, the longitudinal distance between the buttons 98 makes it difficult, if not impossible, for a small child to disengage both connector arrangements simultaneously. Without such simultaneous disengagement, the infant support unit 52 remains safely secured within the playard 54. Indeed, disengagement of only one side of the unit 52 does not allow or permit the unit to be tipped or reoriented.

Figure 7A:
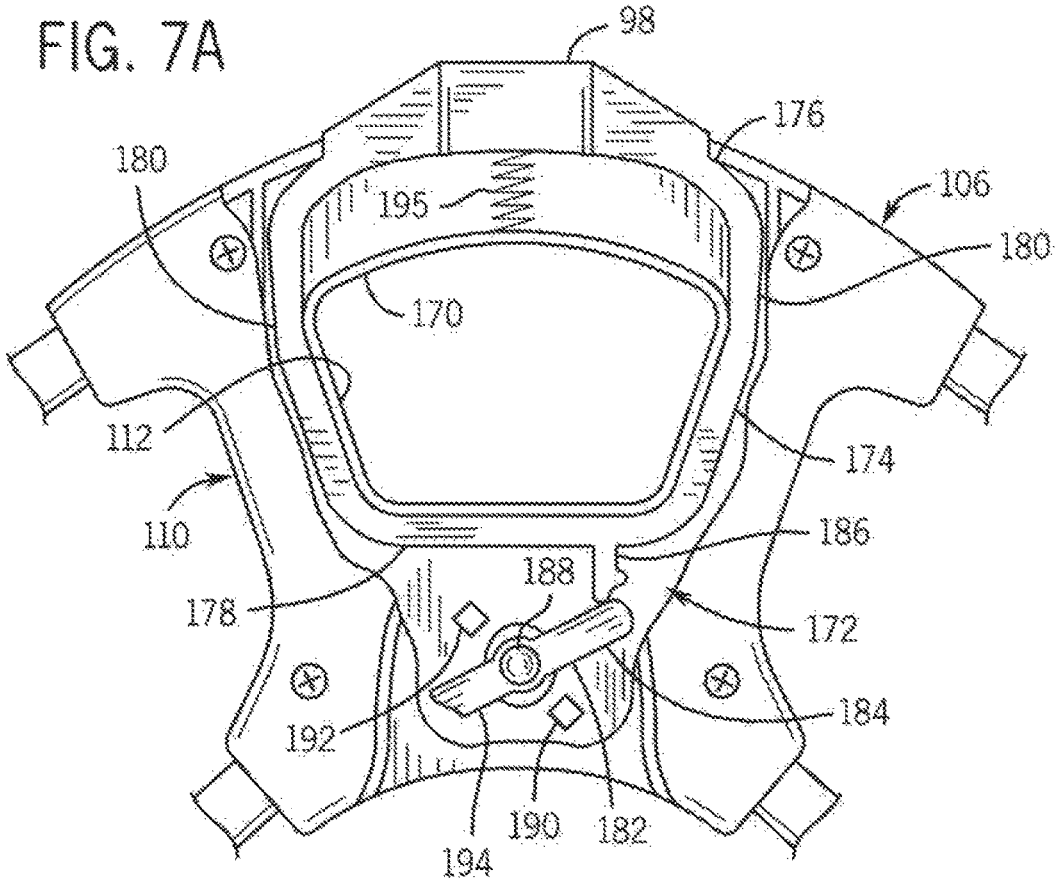
FIG. 7A is a partial, elevational view of an exemplary release mechanism of the handle stand of FIG. 6 in a locked or unreleased state.
Figure 7B:
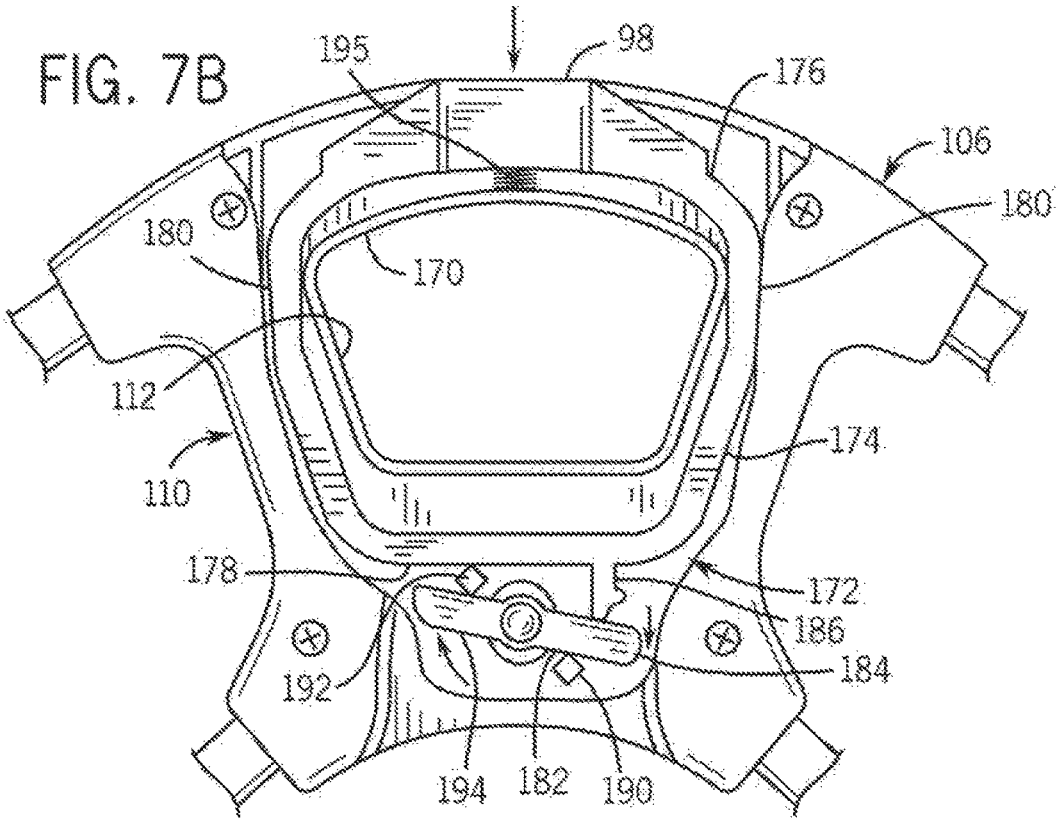
FIG. 7B is a partial, elevational view of the handle stand release mechanism in an unlocked or released state.

With reference now to FIGS. 7A-7D, one example of a release mechanism 172 to be actuated by the push-button 98 of the handle stand 106 is shown. The housing 110 of the handle stand 106 is shown with one of the housing shells partially removed to reveal the release mechanism 172. In this example, the release mechanism 172 includes a ring-shaped shuttle 174 integrally formed or otherwise in communication with the release button 98. The shuttle 174 includes a plastic or other rigid body having a top side 176, a bottom side 178, and a pair of upright carriage arms 180 that descend through the housing 110, extending around a rim of the hole 112 to link the sides 176 and 178. Downward movement of the release button 98 causes the top side 176 to approach the inner side of the grip surface 170, or top of the hole rim, thereby displacing the carriage arms 180 and the bottom side 178 downward from the position shown in FIG. 7A to the position shown in FIG. 7B. That displacement, in turn, rotates a lever 182 having a radial arm 184 driven by a push arm 186 downwardly extending from the bottom side 178 of the shuttle 174. The lever 182 rotates about a pivot 188 until the arm 184 contacts a stop 190, as shown in FIG. 7B. Another stop 192 may be provided for another radial arm 194 of the lever 182. A return spring 195 bears against the underside of the grip surface 170 to bias the release button 98 toward the position shown in FIG. 7A. As a result, the shuttle 174 is biased upward in the direction B shown in FIG. 7C.

Figure 7C:
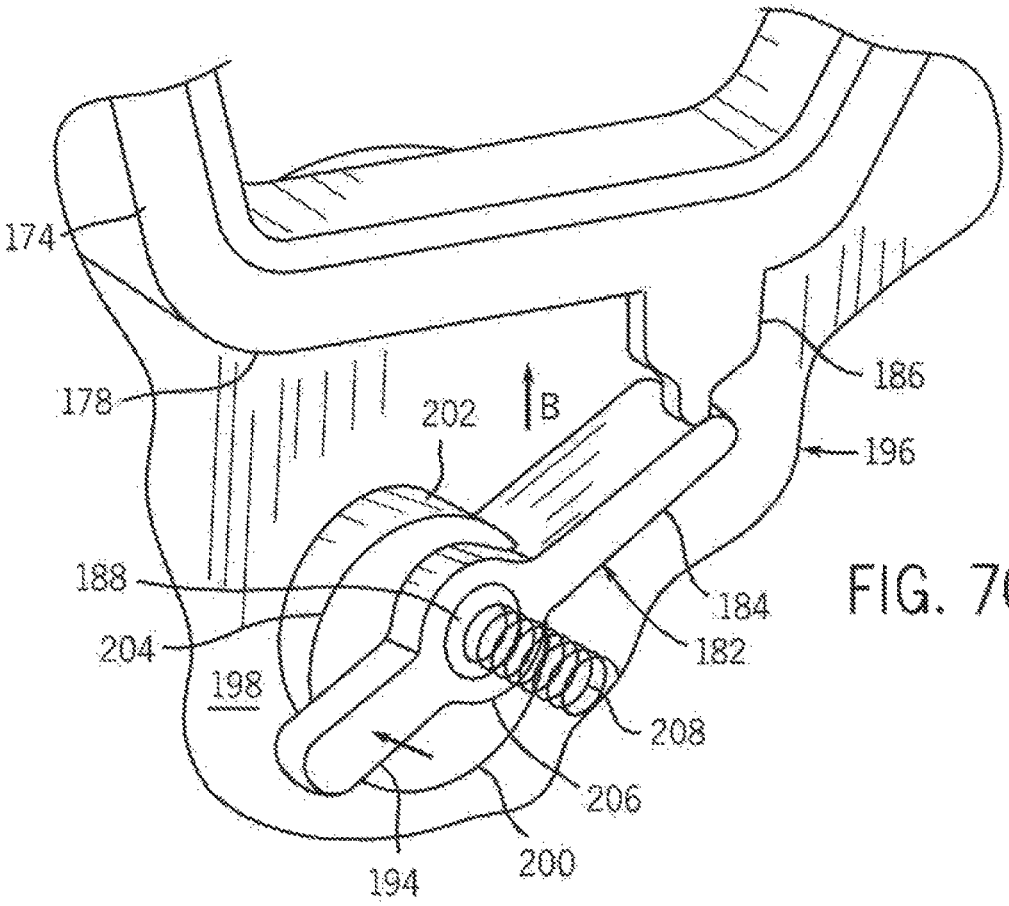
FIG. 7C is a partial, perspective view of the handle stand release mechanism in the locked or unreleased state.
Figure 7D:
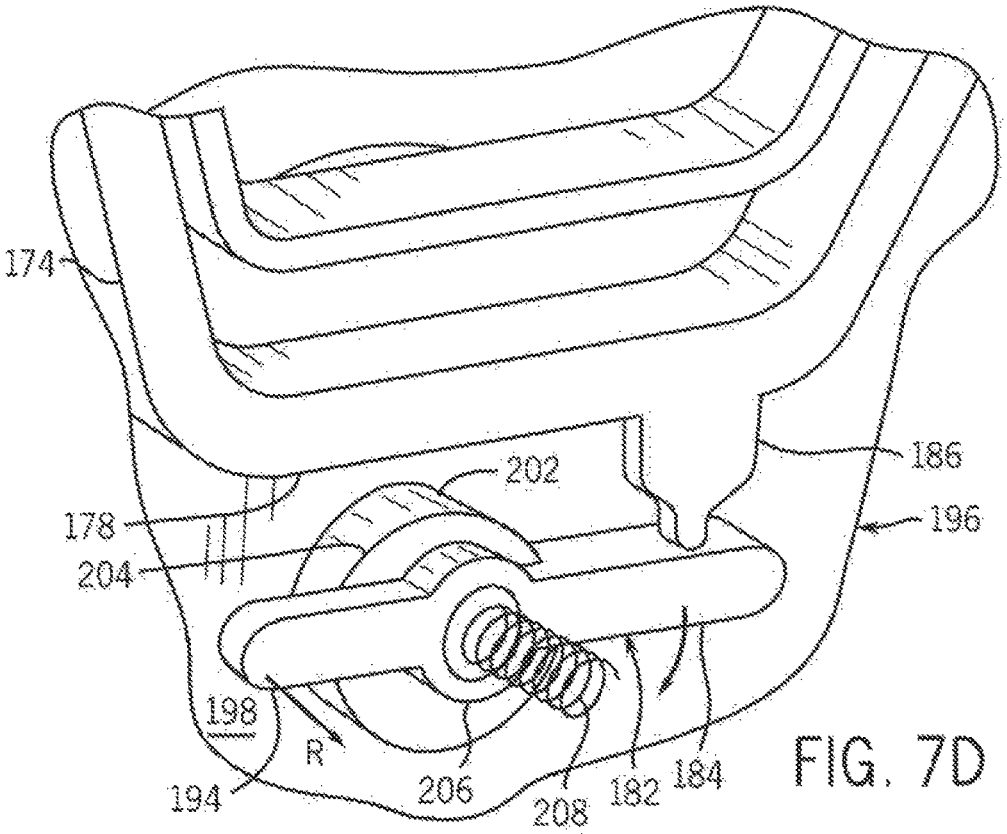
FIG. 7D is a partial, perspective view of the handle stand release mechanism in the unlocked or released state.

FIGS. 7C and 7D depict how the linear displacement of the shuttle 174 is translated into transverse motion of the button 152 (FIG. 4) relative to the face 134 of the connecting structure 94. A shell 196 of the housing 110 includes a generally flat, inner surface 198 on which a ramp 200 is mounted about the pivot axis of the lever 182. One or both of the radial arms 184, 194 may be guided by an exterior wall 202 of the ramp 200 when rotated by the push arm 186. As the lever 182 rotates, the radial arm 194 ascends an inclined front face 204 of the ramp 200. As a result, both the radial arm 194 and a ring 206 of the lever 182 are displaced in a direction R as shown in FIG. 7D. That displacement, in turn, retracts the button 152 into the face 134 because the ring 206 is coupled or linked to the button 152 through a hole in the ramp 200. Retraction of the button 152 allows the infant support unit 52 to be disengaged from the bassinet 56 and lifted out of the playard 54. Another return spring 208 is disposed between the button 152 and the other shell (not shown) of the housing 110 to bias the button 152 away from the retracted position. During operation as the unit 52 is lowered onto the mounts, the return spring 208 compresses as the button 152 rides along the chamfer 148 (FIG. 4), and slides along the face 146 (FIG. 4), before fitting into the receiver hole 150 (FIG. 4).

As shown in FIGS. 7C and 7D, each segment of the shuttle 174 may be shaped as a strip oriented on an end relative to the housing shells. The width of the strips may correspond with the width of the cavity formed by the housing shells, which therefore guide the shuttle 174 as the release mechanism is actuated. The strip shape and orientation of the shuttle 174 also provides a surface on which the spring 195 is seated as it acts against the housing shell, which may have a lip along the rim of the opening 112 for the same purpose.

The construction and configuration of the release mechanism may vary greatly from the example of FIGS. 7A-7D. Thus, the manner in which the connecting structure 94 is released may also vary considerably. The connecting structure 94 may rely on a variety of different release mechanisms for triggering and actuating the disengagement in response to the movement of the release button 98. For example, a cable-based release mechanism may utilize a release button that is pressed upward to disengage the infant support unit. Another shuttle-based example may include a wedge inserted into a gap between a rod or other object linked to the button of the connecting structure. As the wedge is increasingly driven into the gap, the rod is displaced in the transverse direction, thereby retracting the button in a manner similar to that described above.

Figure 8:
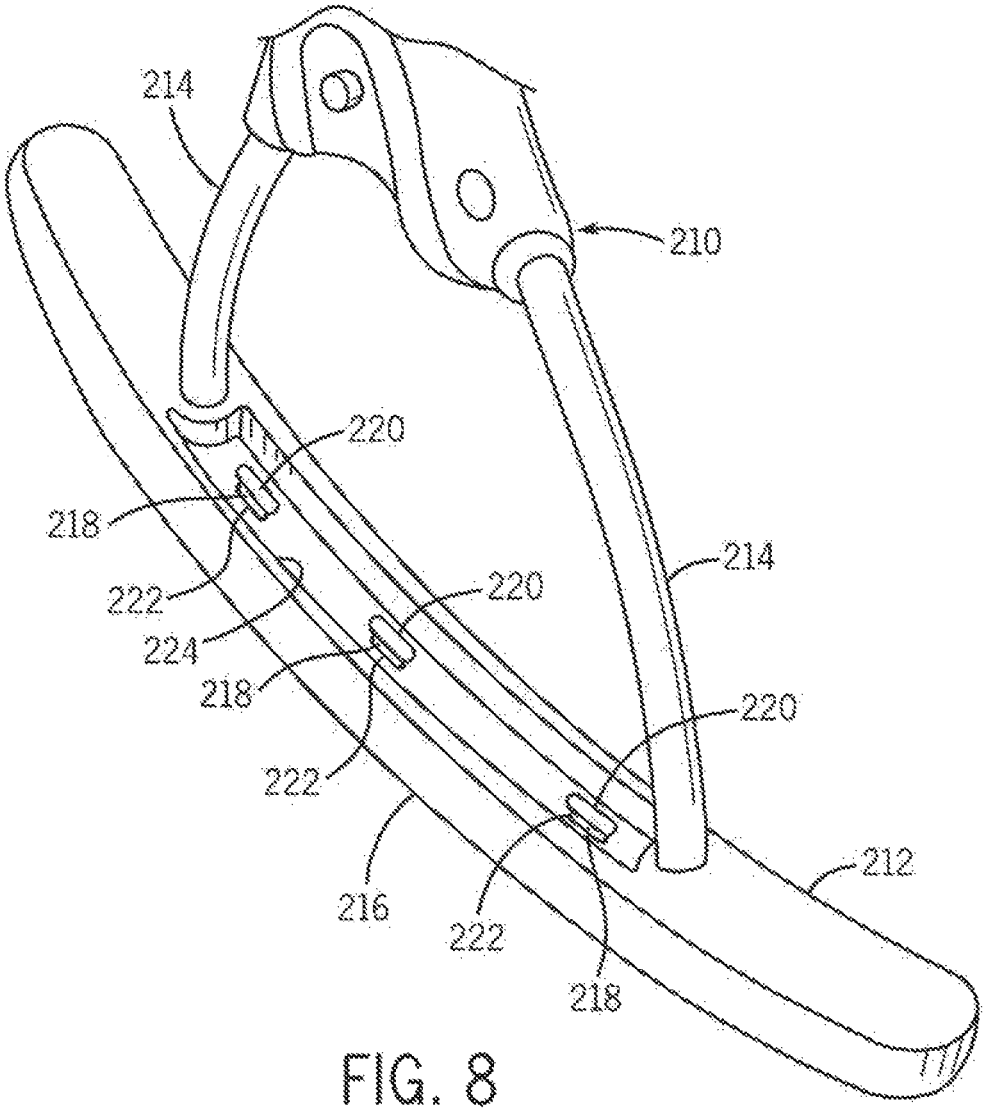
FIG. 8 is a partial, perspective view of the infant support unit of FIG. 3 with an exemplary rocker bar of the handle stand.

Turning to FIG. 8, an alternative handle stand 210 includes a rocker bar 212 to provide another independent mode of operation for an infant support unit of the disclosed systems. The stand 210 may be configured in a manner similar to that described above except with legs 214 terminating at the rocker bar 212 instead of feet. The rocker bar 212 may be configured with a continuous curvature as an arch that curves upward from a base section 216 between attachment points for the legs 214. To avoid undesired slippage during use, the underside of the rocker bar 212 may have a non-slip (e.g., rubberized) strip that extends generally the length of the rocker bar 212. The non-slip strip may have a set of upward projections 218 with a prong- or hookshaped or otherwise oversized head 220 to engage the rocker bar 212. Each projection 218 is captured in a hole 222 that passes through the rocker bar 212 to reach the underside surface. The head 220 of each projection 218 is oversized relative to the hole 222 so that the projections 218 and, thus, the non-slip strip, remain in place. A groove 224 extends along a top surface of the rocker bar 212 between the leg attachment points to provide access to the holes 222. Each leg 214 may be attached via an interference fit with a hole formed in the rocker bar 212.

Figure 9:
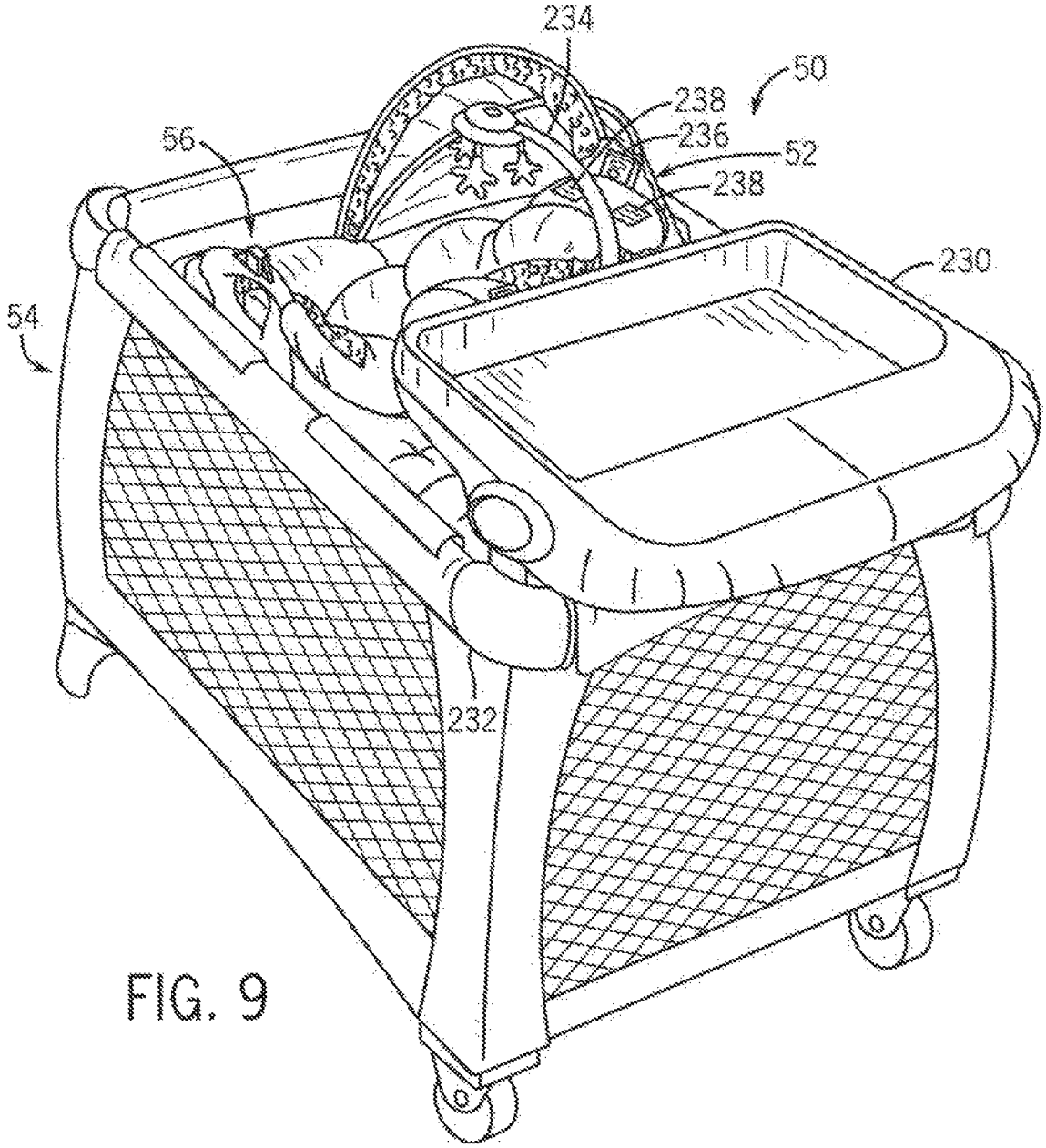
FIG. 9 is a perspective view of the child containment system of FIG. 1 with a number of accessories to support additional modes of operation, including an exemplary changing table mounted next to the infant support unit, an entertainment mobile mounted on the infant support unit, and a sound playback system.

With reference now to FIG. 9, the system 50 is shown in yet another operational mode in which the system 50 has the infant support unit 52 installed in the bassinet 56, which is, in turn, installed in the playard 54. In this mode, a changing table 230 is also installed in the bassinet 56 and coupled to the playard 54. The changing table 230 may be conventionally configured and secured to posts 232 of the playard 54. The manner in which the infant support unit 52 is disposed widthwise across the bassinet 56 occupies only half or less of the area provided by the bassinet 56, thereby leaving sufficient room for the changing table 230. In this example, the changing table 230 occupies approximately half of the area provided by the bassinet 56. One of the benefits of the above-described connection arrangement allows the infant support unit 52 to be coupled to, and disengaged from, the bassinet 56 as the changing table 230 remains secured in position. As described above, the connection arrangement allows the unit 52 to be generally directly lowered onto the mounts located on the bassinet clips. Another unexpected benefit of accommodating the changing table 230 involves the safe positioning of the infant support unit 52 in the end wall of the playard 54 as described above.

The operational mode shown in FIG. 9 also provides examples of further operational features made available via the infant support unit 52. A toy mobile 234 is shown cantilevered or suspended over the sleeping area of the infant support unit 52, and may be coupled to the frame of the infant support unit 52 via, for instance, a hub (not shown) attached at or near the point at which the canopy is attached to the frame. Music or other sound playback is made available via an MP3 player 236 mounted near a head end of the unit 52. In this example, a pair of speakers 238 are disposed on either side of the player 236. The locations, configurations, and other characteristics of these components may vary considerably from the example shown, and are provided more for the purpose of demonstrating the versatility of the operational modes of the system 50.

Figure 10:
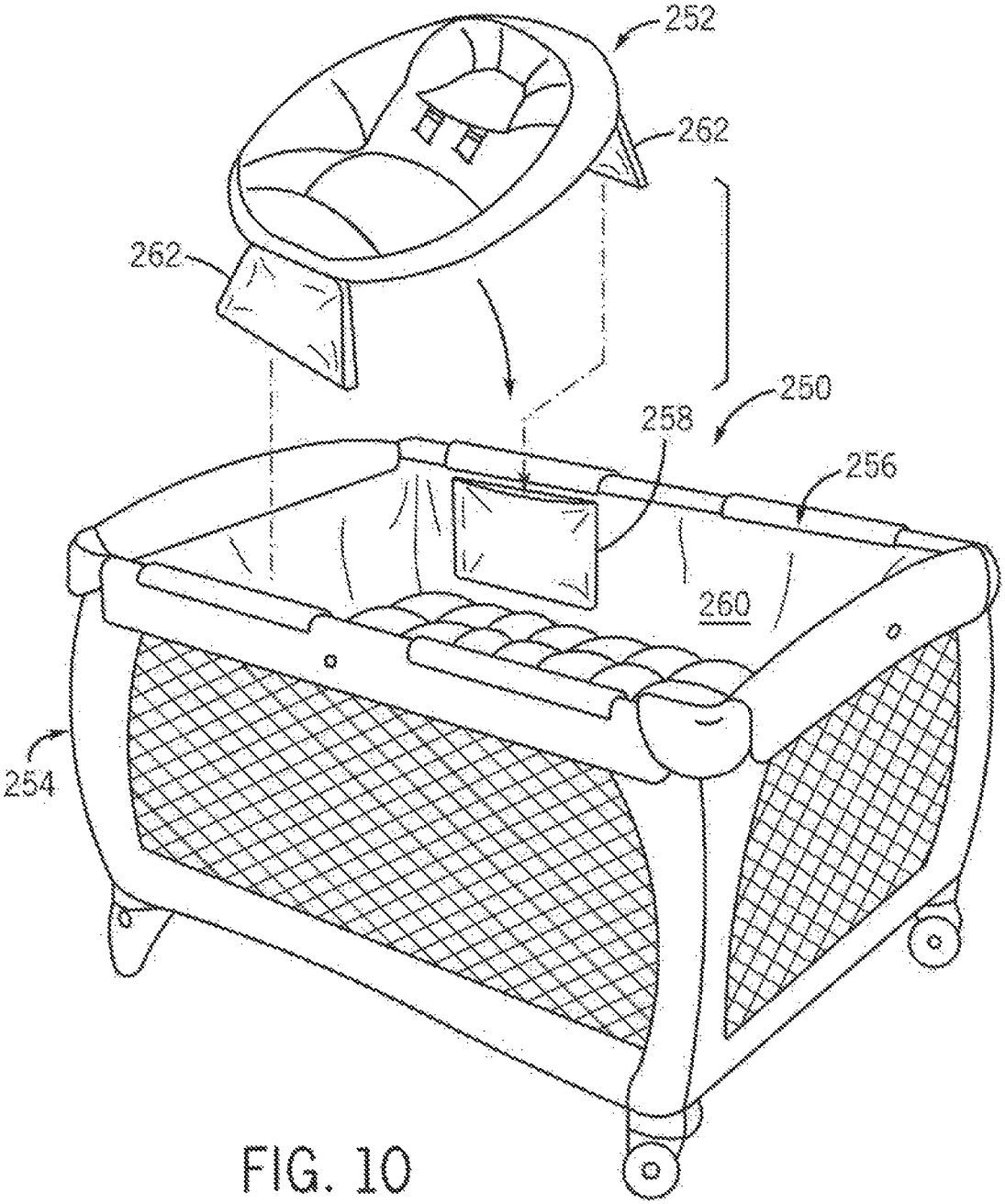
FIG. 10 is an exploded, perspective view of another exemplary child containment system having an infant support unit with support stands used in both coupled and independent infant support modes in accordance with one embodiment.

FIG. 10 depicts another exemplary system 250 capable of use in multiple operational modes. In this example, the system 250 includes an infant support unit 252 configured for optional engagement with a playard 254 having a bassinet 256 installed in the playard 254 as described above. The connection arrangement in this example involves pockets 258 formed along side panels 260 of the bassinet 256. Each pocket 258 may be formed in soft goods sewn onto or formed from the soft goods of the panel 260. The pockets 258 act as seats for a pair of upright, wire form stands 262 of the unit 252. The pockets 258 may include a stiffener panel to maintain an open, upright position. In some cases, the wire form stands 262 are bent into a triangular frame to provide a wide base during independent use. Each stand 262 may be covered in soft goods as shown. The upright nature of the stands 262 allows the spacing between the unit 252 and the walls or panels of the bassinet 256 to be minimized as described above. Thus, the unit 252 may be sized such that the stands 262 butt up against the walls of the bassinet 256 just as with the examples described above. Moreover, as wire form structures, the stands 262 introduce minimal additional spacing to the gaps, while the pockets 258 are as thin as the fabric material used to create them.

Figure 11A:
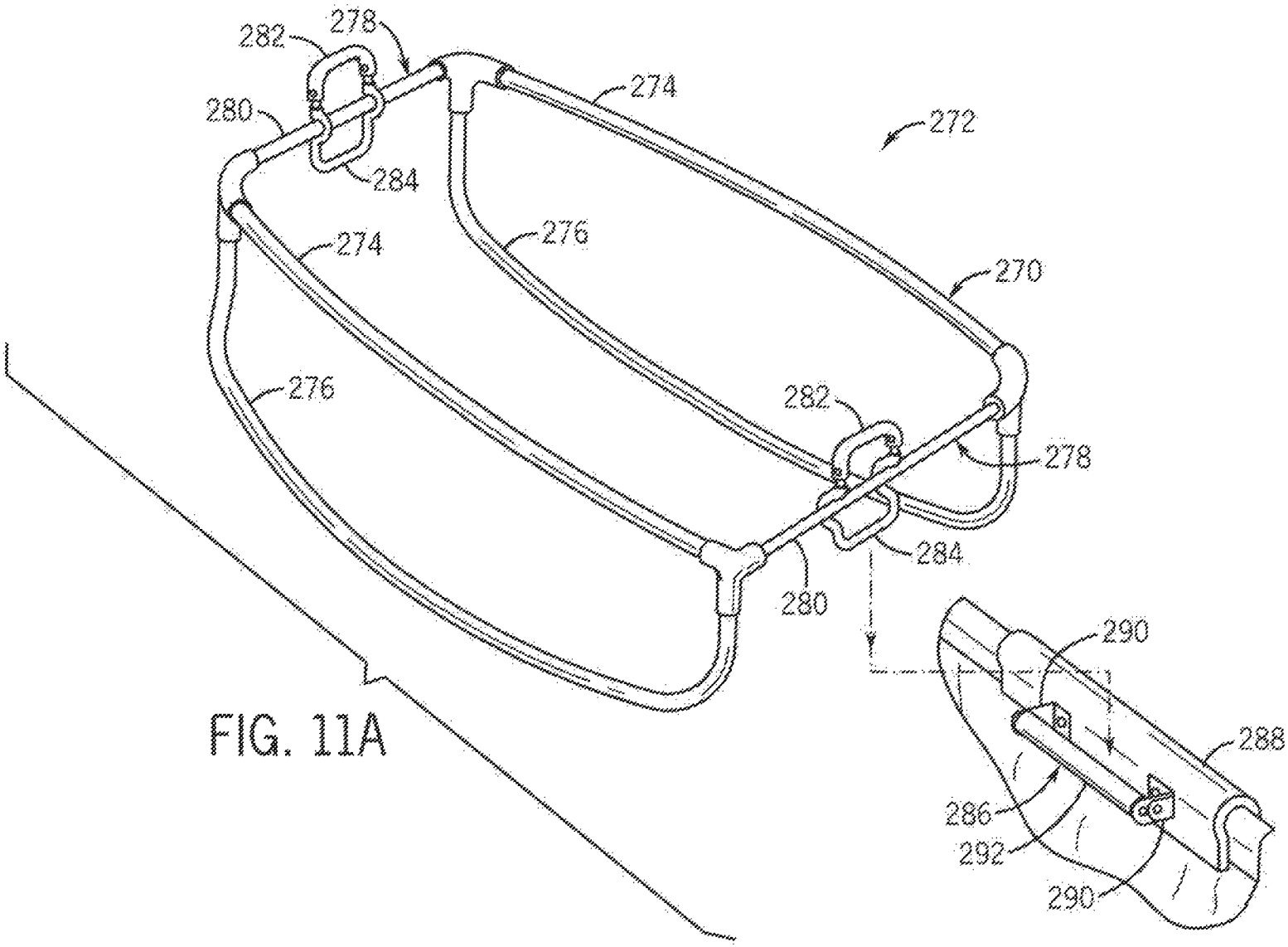
FIG. 11A is a partial, exploded, perspective view of another exemplary child containment system with a frame of an infant support unit configured for engagement with a child containment structure and for use in multiple infant support modes in accordance with several aspects of the disclosure, including a rocker infant support mode.
Figure 11B:
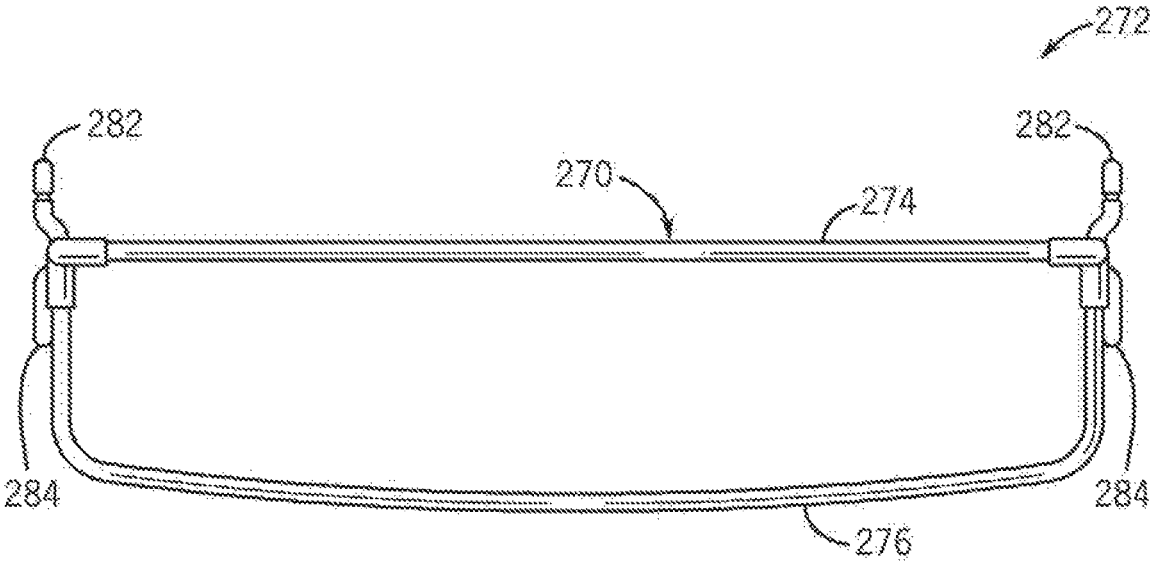
FIG. 11B is a front, elevational view of the exemplary frame of FIG. 11B to show the rocker functionality thereof in greater detail.
Figure 11C:
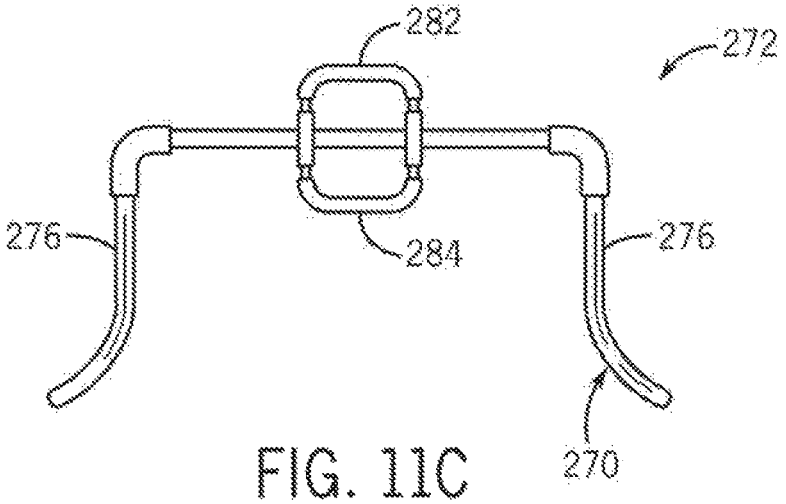
FIG. 11C is an end, elevational view of the exemplary frame of FIG. 11C to show handle and connector aspects thereof in greater detail.

FIGS. 11A-11C depict a frame 270 of another exemplary infant support unit 272 configured for use in both coupled and independent operational modes. The frame 270 includes upper and lower pairs of spaced apart longitudinal side tubes 274, 276 that run lengthwise between ends 278. Soft goods are suspended from the upper side tubes 274 to form the hammock-like environment described above. As best shown in FIG. 11B, the lower side tubes 276 are arched over their length to act as rocker bars and curve upward at the ends 278 to meet the upper side tubes 274 and act as support legs or stands for the unit 272. The lower side tubes 276 may be bent outward as shown in FIG. 11C to form a wider base for the unit 272. Each end 278 includes a tube 280 that extends laterally between the upper tubes 274 that spaces the pairs of tubes from one another. Each end 278 also includes a wire form handle 282 secured to the tube 280 in any desired manner. The handle 282 may, for instance, include a section bent around the tube 280 to fixedly engage the tube 280. In this example, the wire of the handle 282 extends downward beyond the points at which it engages the tube 280 to form a connector 284, which may be a U-shaped hook. Together, the handle 282 and the connector 284 form a wire form loop, as the connector 284 is shaped as the inverse of the handle 282.

As shown in FIG. 11A, each connector 284 engages a mount 286 fastened to a bassinet clip 288 to support the coupled operational mode. The mount 286 includes a pair of brackets 290 extending inward from the clip 288 to support a rod, strip, or crossbar 292 spaced from the bassinet clip 288 to form a channel in which the connector 284 is captured.

In these and other cases, the infant support units of the disclosed systems need not only rely on mounts or other connectors to maintain the positioning of the unit during the coupled mode of operation. The coupled operational mode also includes arrangements in which the coupling is achieved via the complementary sizes of the unit and the space into which it is lowered. For example, the infant support units described herein may be sized so as to prevent or discourage the tipping of the unit during the coupled mode of operation. One unexpected benefit of having the infant support units fit snugly within the interior space of the bassinet or playard involves the positioning of structural components around the perimeter of the space. With legs, stands, and other components butted up against or otherwise disposed along the perimeter, the infant support unit does not introduce objects into the open space of the playard or bassinet that would otherwise present a potential safety hazard.

Figure 12:
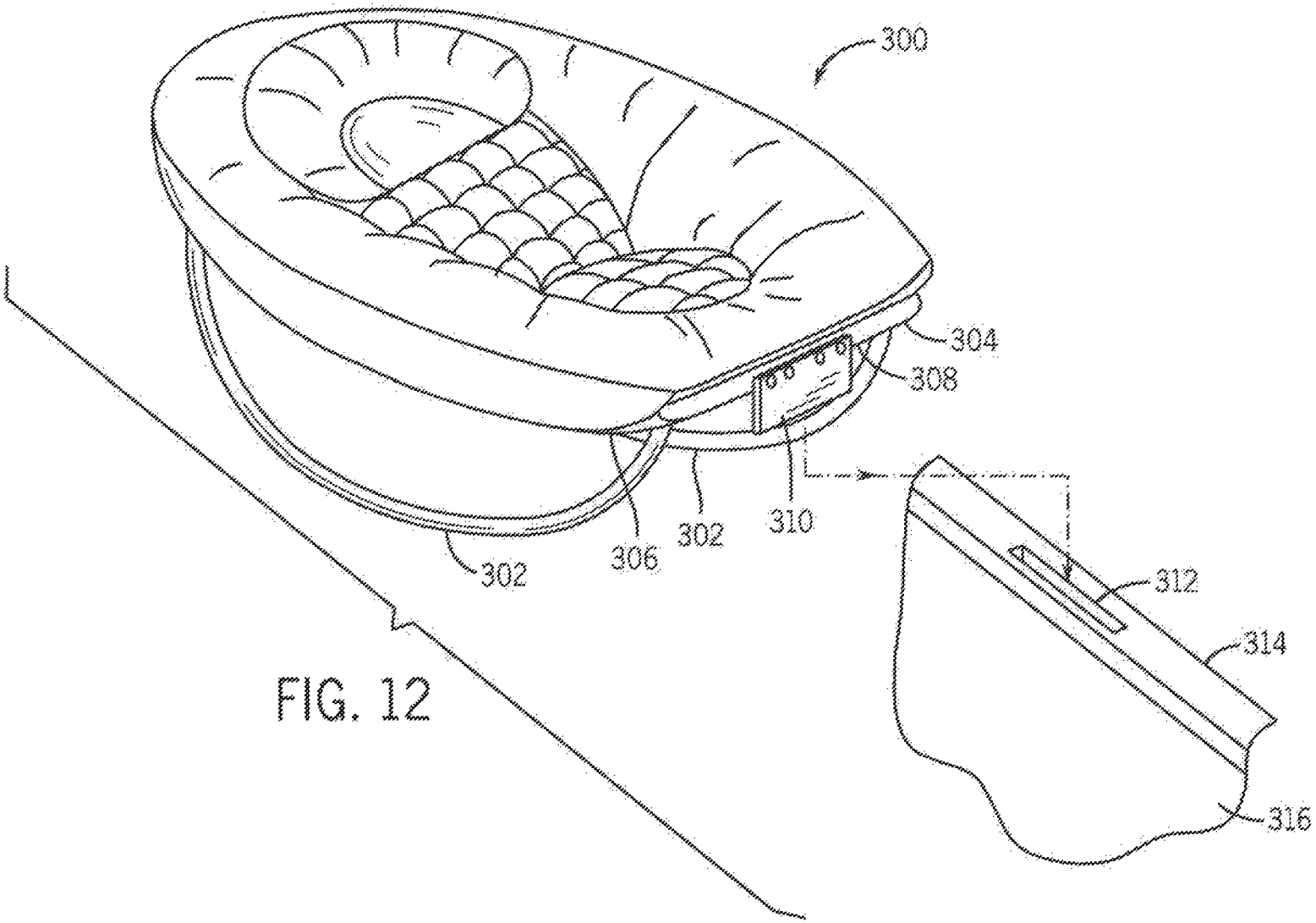
FIG. 12 is a partial, exploded, perspective view of yet another exemplary child containment system having an infant support unit with connectors for a coupled infant support mode and rocker bars for an independent infant support mode.

FIG. 12 depicts another example of an infant support apparatus or unit 300 suitable for use as part of a child containment system that can be used in an independent operational mode as a rocker or cradle. The unit 300 includes a pair of curved rocker bars 302 that arch downward from a bed frame 304 that includes a pair of side tubes 306 and a pair of end tubes 308. A downwardly projecting plate 310 is fastened to each end tube 308 to act as a connector or hook for mounting the unit 300 in a playard/bassinet combination as described above. The plate 310 is captured in mounting slots or pockets 312 formed in a bassinet clip 314 disposed along side walls 316 of the playard/bassinet combination as described above. Each slot 312 provides a mounting point for the unit 300 for the coupled operational mode.

Figure 13:
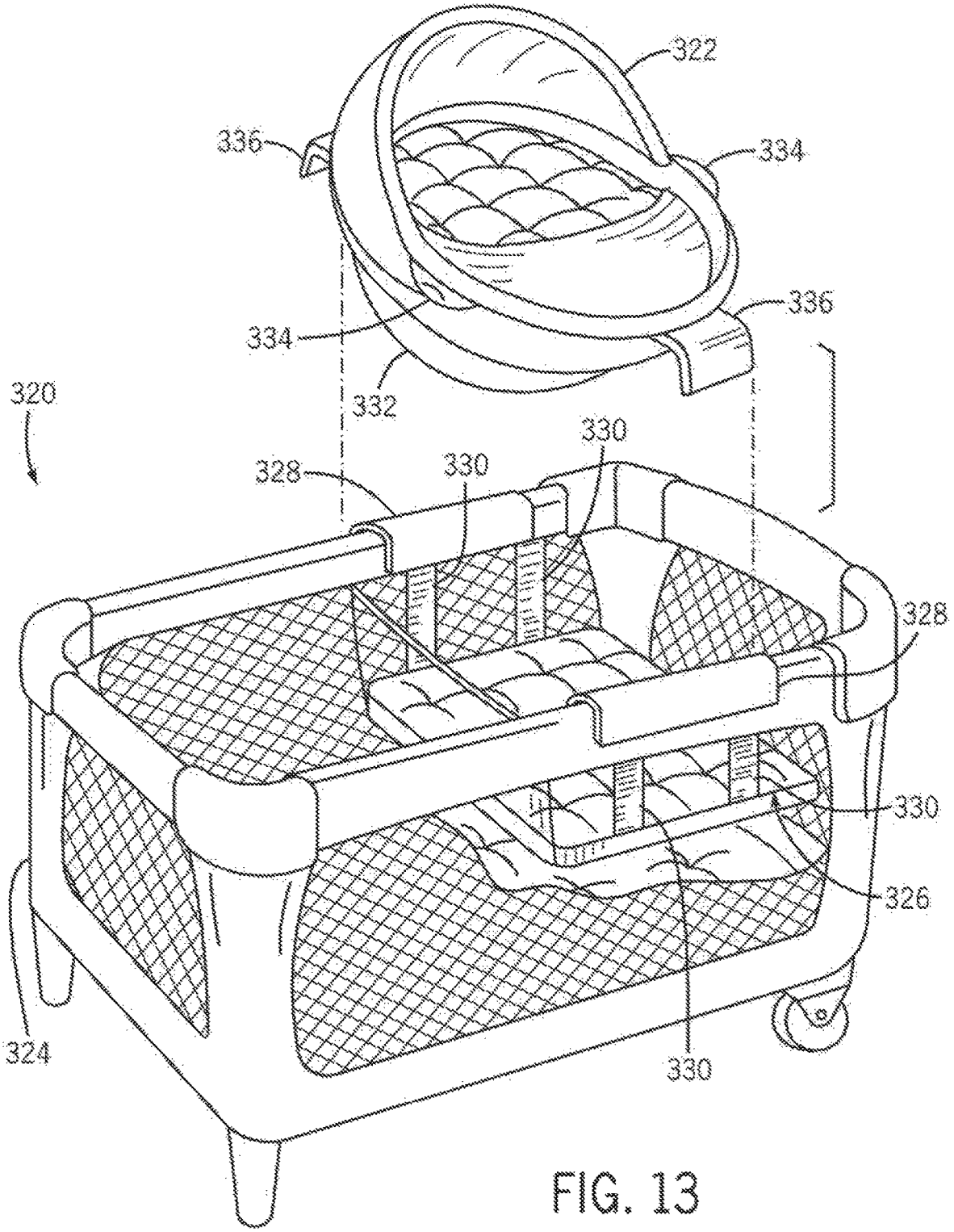
FIG. 13 is a partial, exploded, perspective view of still another exemplary child containment system having an infant support unit with connectors for a coupled infant support mode and a rocker base for an independent infant support mode.

FIG. 13 depicts another exemplary child containment system 320 having an infant support unit 322, a playard 324, and a bassinet 326. In this example, the bassinet 326 only occupies a portion (e.g., half) of the interior space of the playard 324. The bassinet 326 may be suspended with the playard 324 via clips 328 to which support straps or bands 330 are attached. The infant support unit 322 includes an oval base 332 to provide cradle or rocker feature when used in the independent operational mode, a pair of side handles 334, and end mounting clips or hooks 336 to engage the bassinet clips 328 for use in the coupled operational mode. The oval base 332 may be shaped as a rigid shell as an alternative to a tubular frame (or other structural framework involving rocker bars).

As an alternative to the hook-shaped clips 328, the infant support units of any of the disclosed systems may include one or more spring-loaded or otherwise adjustable latches that engage the bassinet or playard walls or rails or other component thereof (e.g., bassinet clips). For example, each latch may include an arm or other projection pivotably coupled to an end of the infant support unit. The arm may have a saddle or other catch or other connecting element shaped to engage the bassinet or playard. The arm may pivot from a folded position along the frame or bed of the unit (e.g., generally vertical) to an extended position (e.g., generally horizontal) to reach over and engage the bassinet or the playard. The latch arm may also be shaped with an angled lead-in or other end configured to cause the rotation from the folded position to the extended position when the arm contacts the bassinet or playard as the unit is lowered into position. In this way, the latch automatically rotates into the extended position for engagement.

Figure 14:
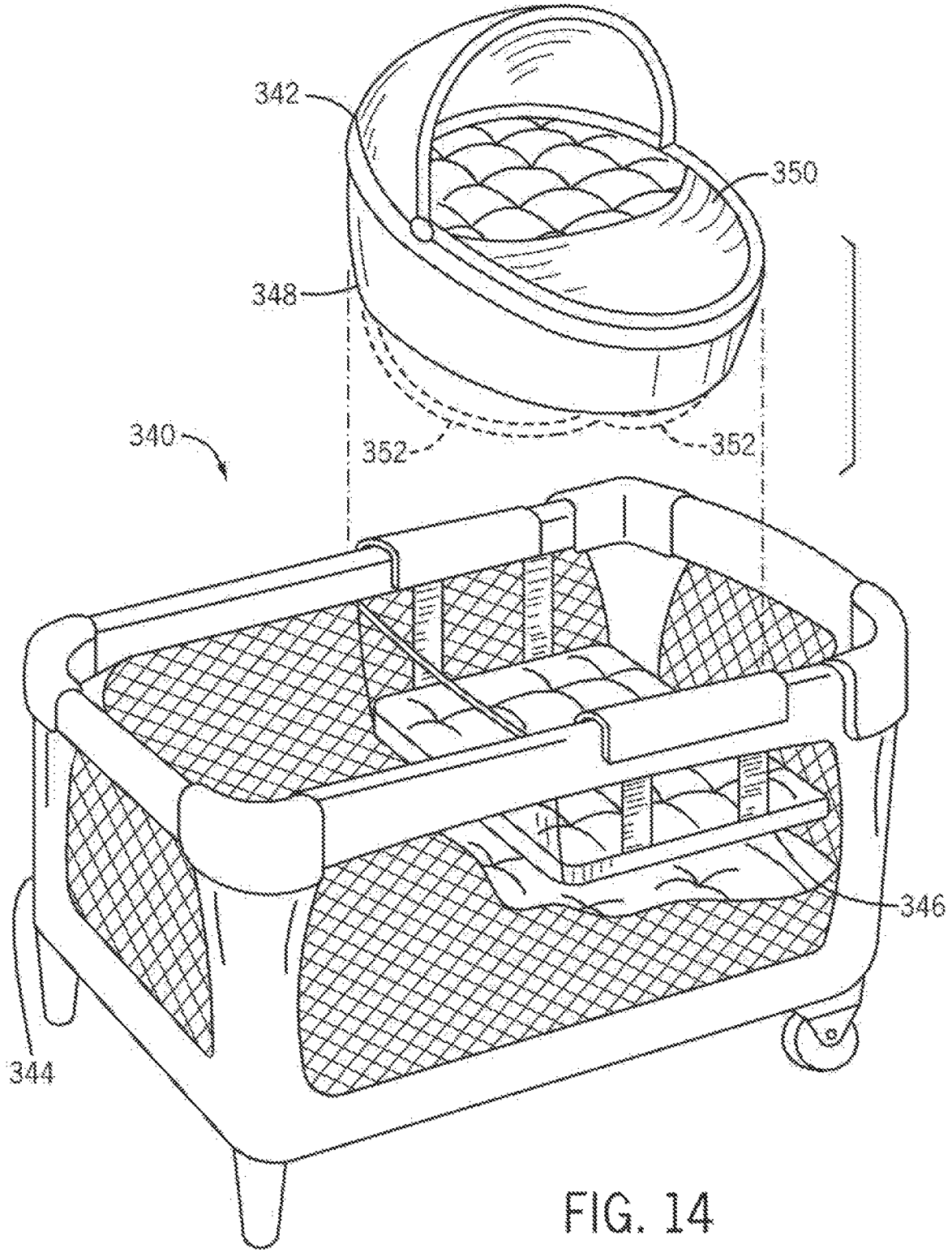
FIG. 14 is an exploded, perspective view of still another exemplary child containment system having an infant support unit with a rigid skirt base for a coupled infant support mode and detachable rocker bars for an independent infant support mode.

FIG. 14 depicts another exemplary child containment system 340 having an infant support unit 342, a playard 344, and a bassinet 346. The playard 344 and the bassinet 346 may be configured in a similar manner to any one of the playards and bassinets described above. In this example, the infant support unit 342 has a rigid, skirt-shaped base 348 used for supporting a bed 350 in both coupled and independent operational modes. The base 348 may have a set of receptacles for attaching optional rocker bars 352 that extend downward from the skirt-shaped base for a rocker operational mode. In an alternative embodiment, the skirt-shaped base 348 is partially or fully composed of a foam or partially stiff material that provides structural support with a desired amount of cushioning, resilience or other flexibility for comfort or operation (e.g., bouncer) during the independent mode of operation.

Figure 15:
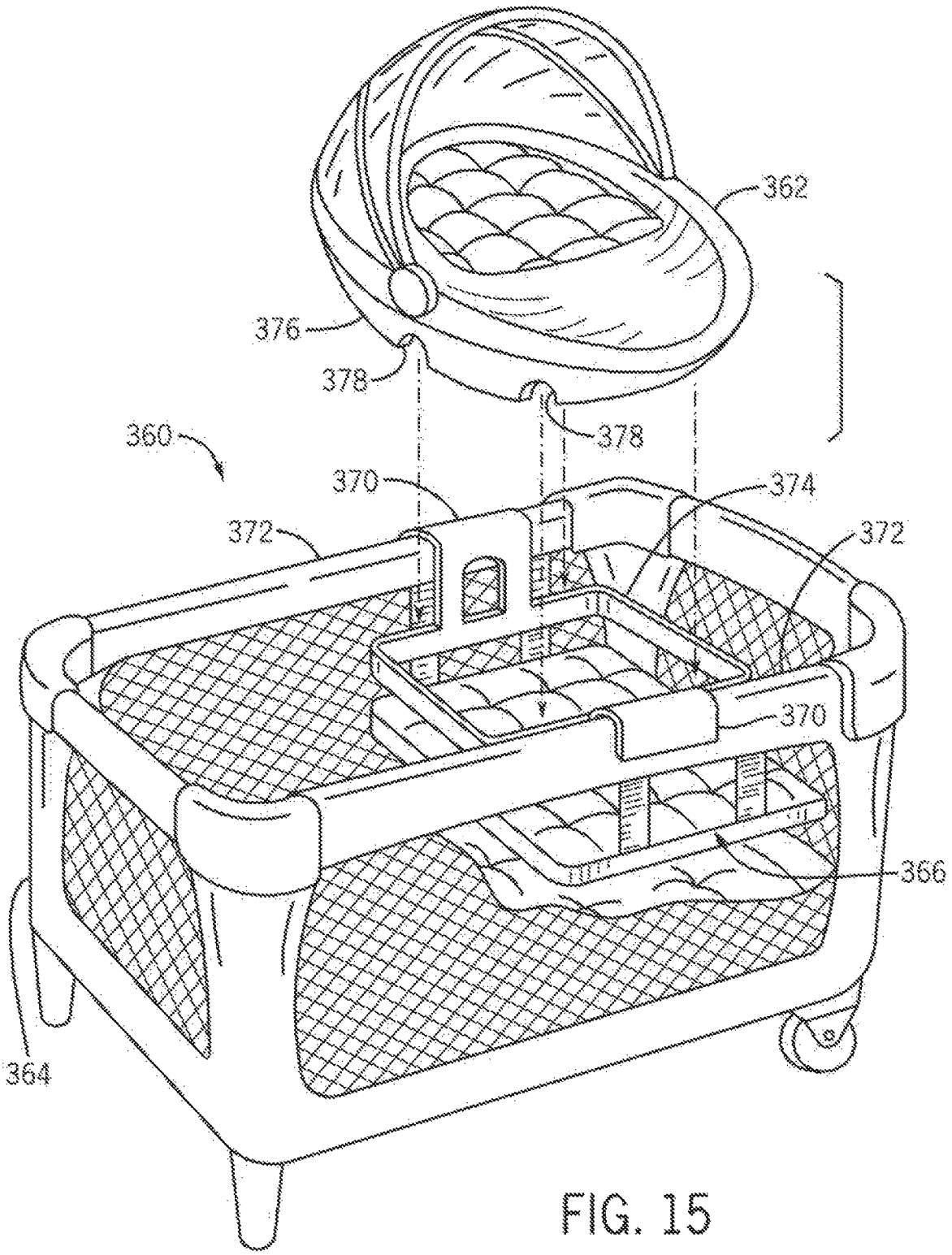
FIG. 15 is an exploded, perspective view of still another exemplary child containment system with an infant support unit and an adapter frame to receive the infant support unit in a coupled infant support mode in which notches in a rigid skirt base engage the adapter frame, the rigid skirt base being used in an independent infant support mode.

FIG. 15 depicts another exemplary child containment system 360 with an infant support unit 362 mounted on a playard 364 in which a bassinet 366 is suspended. In this example, the unit 362 engages a mounting frame 368 suspended within the bassinet 366, which is only partially shown for ease in illustration. The frame 368 includes a pair of connector clips 370 that engage top rails 372 of the playard 364. The clips 370 may be integrally formed with a base frame 374 that includes a set of bars or rods on which the unit 362 rests. To that end, the unit 362 includes a rigid base 376 having notches 378 formed in a bottom surface of the base 376 and configured to receive the bars or rods of the frame 374 when the unit 362 is used in the coupled operational mode. The bottom surface of the base 376 of the unit 362 may be curved to provide a rocker feature when used in the independent operational mode.

Figure 16:
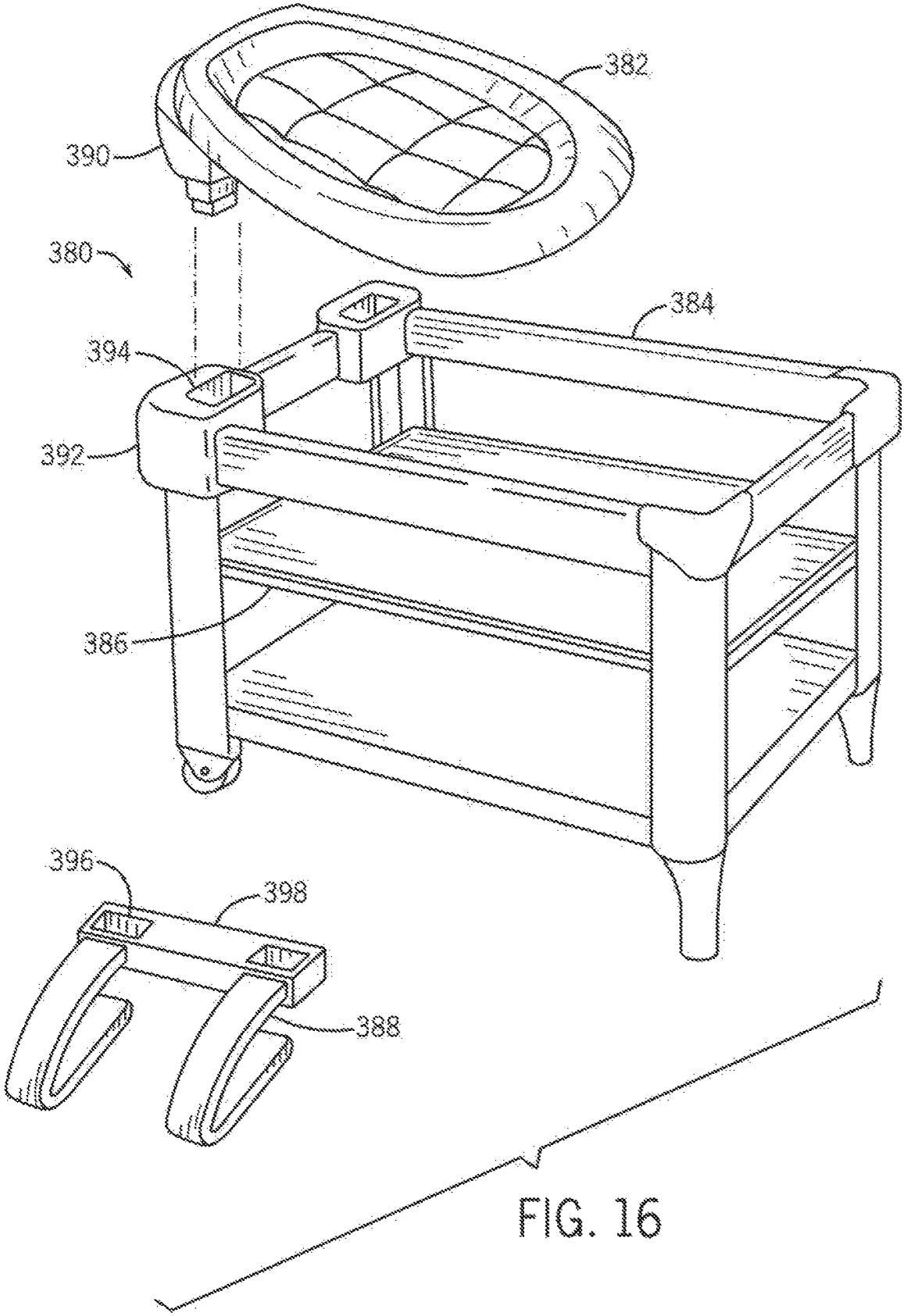
FIG. 16 is an exploded, perspective view of still another exemplary child containment system with an infant support unit having a number of posts captured in playard receiver(s) in a coupled infant support mode and rocker receiver(s) in an independent infant support mode.

FIG. 16 depicts another exemplary child containment system 380 having an infant support unit 382, a playard 384, and a bassinet 386. In this example, the infant support unit 382 is coupled to a bouncer frame 388 when used in an independent operational mode. To that end, the unit 382 has a frame 390 with a pair of post connectors that are also used to engage the playard 384 during a coupled operational mode. The post connectors of the frame 390 are configured to engage receivers 392 disposed along top rails of the playard 384. Each receiver 392 includes a socket or receptacle 394 configured to securely accept one of the post connectors of the unit frame 390. To that end, each connector may include a spring-loaded pin or ball or other mechanism that engages a complementary feature in the socket 394. The sockets 394 may, but need not, be located in corners of the playard as shown. In that case, the sockets 394 may be used interchangeably for either the infant support unit 382 or a changing table as described above. As a result of the connection, the infant support unit 382 is suspended above the bassinet 386 in a cantilevered formation in this case. To avoid a cantilevered suspension, the other corners, sides, or ends of the infant support unit 382 may include one or more hooks, clips, or other connectors to engage the bassinet clips, playard rails, etc. These connectors may be stowable or otherwise adjustable so that they avoid interfering with use in the independent operational mode. During the independent operational mode, the post connectors of the unit 382 engage receivers 396 located on a cross bar 398 of the bouncer frame 388. Each receiver 396 may include socket and other features similar to the receptacles 394 on the playard 384.

In an alternative embodiment, the infant support unit 382 may include one or more additional posts or legs (not shown) to support the unit within the bassinet 386. The posts or legs may be adjustable (e.g., pivoting or folding) for movement to a stowed position (e.g., under the bed of the unit 382) during use in the independent operational mode. In yet another alternative, the post connectors of the frame 390 may fold inward so that the unit 382 can rest on other components of the frame 390 during the independent mode of operation. For example, the frame 390 may include a rigid shell that provides a rocker mode of operation as described above. Alternatively, the post connectors or other legs described above do not fold upward but instead stay in position during the independent mode of operation to act as rocker limiters. In this way, the post connectors or other legs provide a safety mechanism by limiting the degree to which the unit can rock.

Other mechanisms for securing the above-described infant support units to a bassinet or playard may include a cross bar or other structural element extending between the sides of the playard. The cross bar may be secured or coupled to the playard rails or bassinet clips as desired. One side or end of the infant support unit may then be attached to the cross bar via clips or other connectors. This type of configuration may also allow the coupled operational modes of the above-described systems to accommodate multiple orientations of the infant support unit. For example, the unit may be turned to any one of the 90 degree orientations and still be coupled to the bassinet or playard. Moreover, such reorientation of the infant support unit is not limited to embodiments having a cross bar, but rather may be available in connection with any of the above-described systems when, for example, the infant support unit has a square shape or has connection structures on all sides.

The above-described infant support units may be configured with a variety of different types of handles. For example, the sides or ends of the units may include a hub from which handle arms extend for pivotable movement between in-use and storage positions. As a result, the handle arms may be rotated such that handle grips are presented for the caregiver above the sleep support surface of the unit for carrying in a basket arrangement. Such pivot- or hub-mounted handles may also be rotatable downward from the carrying positions to a position below the bed of the infant support unit to act as a stand(s) for the independent mode of operation or connectors for the coupled mode of operation. To that end, each hub may be configured with a lock-and-release mechanism that maintains the position of the handle as desired.

The above-described infant support units may be configured with a variety of different connectors, including those that engage the bassinet, bassinet clip, playard, or playard rail directly. For example, the ends or sides of the units may include a flexible attachment mechanism that engages the bassinet or playard via a press fit engagement as the unit is lowered into position for the coupled operational mode. The flexible attachment mechanism may be configured as a close-pin or other clasp arrangement that first opens to fit over the bassinet or playard and then closes to secure the engagement once the unit is fully lowered.

The above-described infant support units and other structural components of the disclosed child containment systems may be formed of a variety of materials, including plastic, and may take on other configurations and forms than those shown in the examples depicted in the drawing figures. The configuration and construction of the disclosed infant support units and other components of the disclosed systems may vary considerably. The fabrication materials and other characteristics of the infant support units may vary, including, for instance, the size and shape of the infant support units. The configuration and construction of the various infant containment structures disclosed and described herein may also vary considerably. For instance, the materials and manufacturing processes used to fabricate the frame parts may vary as well, and the frame parts may be hollow metal tubes, solid metal parts, plastic or composite round or flat components, combinations of parts and materials, or the like. The disclosed and depicted examples of the infant containment system and units thereof are not intended to be limited to a particular material selection or manufacturing process for any of the components.

The term infant support apparatus or unit is used herein in a broad sense to include products well suited for sleeping and non-sleeping conditions, as well as entertainment activities in which the infant is reclined or partially reclined. Thus, the term infant support unit need not be limited to a horizontal or other bed-like configuration, but rather may include a variety of seat, carrier, cot, cradle, rocker, bouncer, or other configurations or structures in or on which the infant is placed or secured.

Although certain juvenile products and systems have been described herein in accordance with the teachings of the present disclosure, the scope of coverage of this disclosure is not limited thereto. On the contrary, all embodiments of the teachings of the disclosure that fairly fall within the scope of permissible equivalents are disclosed by implication herein.

What is claimed is:

1. A child containment system comprising:

a child containment structure comprising a bottom and a perimeter wall, wherein the bottom and perimeter wall define a child containment enclosure;

a bassinet comprising an infant support surface and a surrounding wall around the infant support surface, wherein the bassinet is removably mounted to the child containment structure with the infant support surface elevated above the bottom of the child containment structure;

wherein the bassinet further comprises a plurality of mounting clips on the surrounding wall, and the plurality of mounting clips hook onto a top rail of the perimeter wall of the child containment structure and suspend the bassinet within the child containment structure, such that the bassinet can slide along the top rail; an infant support unit: a first mount structure that extends from a first inner side of a first mounting clip of the plurality of mounting clips;

a second mount structure that extends from a second inner side of a second mounting clip of the plurality of mounting clips; wherein the mount structure is fastened to the respective first and second mounting clips, and wherein the mount structure comprises a flat inner face with a receiver centered within the face and configured to receive the infant support unit, and a changing table comprising of a pair of post connectors; wherein the top rail of the perimeter wall comprises of a pair of sockets configured to accept the post connectors, and wherein the changing table is removably coupled to the top rail of the perimeter wall such that at least a portion of the changing table is disposed within the child containment structure.

2. The child containment system of claim 1, wherein the child containment structure is a playard.

3. The child containment system of claim 1, wherein the bassinet further comprises a plurality of mounting devices, wherein each of the plurality of mounting devices is removably coupled to the perimeter wall of the child containment structure.

4. The child containment system of claim 1, wherein the changing table overlies a first portion of the infant support surface of the bassinet.

5. The child containment system of claim 1, wherein the changing table is inserted into the bassinet.

6. The child containment system of claim 1, wherein the bassinet is further mounted to the perimeter wall of the child containment structure.

7. The child containment system of claim 6, wherein the bassinet is mounted to the child containment structure via corner supports on the bassinet, whereby the corner supports engage a corresponding corner of the interior perimeter wall of the child containment structure.

8. The child containment system of claim 1, wherein the infant support unit comprises:

a connecting structure comprising a projection extending longitudinally outward from a face of the connecting structure, wherein the projection engages the receiver of the mount structure when the connecting structure is lowered onto the mount structure such that the infant support unit is removably coupled to the child containment structure.

9. A child containment system comprising:

a child containment structure comprising a bottom and a perimeter wall surrounding the bottom, wherein the bottom and perimeter wall define a child containment enclosure;

a bassinet comprising an infant support surface elevated above the bottom of the child containment structure;

a surrounding wall around the infant support surface;

a plurality of mounting clips on the surrounding wall, wherein the plurality of mounting clips hook onto a top rail of the perimeter wall of the child containment structure and suspend the bassinet within the child containment structure, such that the bassinet can slide along the top rail;

an infant support unit;

a first mount structure that extends from a first inner side of a first mounting clip of the plurality of mounting clips;

a second mount structure that extends from a second inner side of a second mounting clip of the plurality of mounting clips;

wherein the mount structure is fastened to the respective first and second mounting clips, and wherein the mount structure comprises a flat inner face with a receiver centered within the face and configured to receive the infant support unit; and a changing table comprising of a pair of post connectors;

wherein the top rail of the perimeter wall comprises of a pair of sockets configured to accept the post connectors, and wherein the changing table is removably coupled to the top rail of the perimeter wall such that at least a portion of the changing table is disposed within the child containment structure.

10. The child containment system of claim 9, wherein the child containment structure is a playard.

11. The child containment system of claim 9, wherein the bassinet is mounted to the child containment structure via corner supports on the bassinet, whereby the corner supports engage a corresponding corner of the interior perimeter wall of the child containment structure.

12. The child containment system of claim 9, further comprising a changing table removably coupled to the child containment structure.

13. The child containment system of claim 12, wherein the changing table is removably coupled to the perimeter wall of the child containment structure and at least a portion of the bassinet is disposed within the child containment structure at the same time.

14. A child containment system comprising:

a playard comprising a bottom and a perimeter wall, wherein the bottom and the perimeter wall define a child containment enclosure;

a bassinet comprising:

an infant support surface; and a surrounding wall around the infant support surface, wherein the bassinet is removably mounted to the playard with the infant support surface elevated above the bottom of the playard;

an infant support unit;

a first mount structure that extends from a first inner side of a first mounting clip of the plurality of mounting clips;

a second mount structure that extends from a second inner side of a second mounting clip of the plurality of mounting clips;

wherein the mount structure is fastened to the respective first and second mounting clips, and wherein the mount structure comprises a flat inner face with a receiver centered within the face and configured to receive the infant support unit; and a changing table comprising of a pair of post connectors;

wherein the top rail of the perimeter wall comprises of a pair of sockets configured to accept the post connectors, and wherein the changing table is removably coupled to the top rail of the perimeter wall such that at least a portion of the changing table is disposed within the child containment structure.

* * * * *